US005545259A

United States Patent [19]

Suzuki et al.

[11] Patent Number: 5,545,259

[45] Date of Patent: Aug. 13, 1996

[54] DISH WASHING MACHINE

[75] Inventors: Hajime Suzuki, Otsu; Tetsuo Harada, Shiga, both of Japan

[73] Assignee: Sanyo Electric Co., Ltd., Osaka, Japan

[21] Appl. No.: 377,356

[22] Filed: Jan. 24, 1995

[30] Foreign Application Priority Data

Jan. 31, 1994 [JP] Japan ..... 6-009900

[51] Int. Cl.[6] ..... A47L 15/46

[52] U.S. Cl. ..... 134/18; 134/25.2; 134/57 D

[58] Field of Search ..... 134/56 D, 57 D, 134/18, 25.2; 68/12.02

[56] References Cited

U.S. PATENT DOCUMENTS 4,559,959 12/1985 Meyers ..... 134/57 D X
5,131,419 7/1992 Roberts ..... 134/57 D X
5,411,042 5/1995 Suzuki et al. ..... 134/57 D

FOREIGN PATENT DOCUMENTS 6-48724 3/1985 Japan .
5-49584 3/1993 Japan .

*Primary Examiner*—Philip R. Coe
*Attorney, Agent, or Firm*—Beveridge, DeGrandi, Weilacher & Young, L.L.P.

[57] ABSTRACT

In a dish washing machine according to the present invention, the contents of washing and rinsing are changed depending on dirt to prevent water from being uselessly used particularly if the degree of dirt on the dishes is low. Therefore, in the first drainage process in the latter part of the washing, the drainage is first started IS2-1). If 20 seconds have elapsed since the drainage was started, the drainage is stopped (S2-3). If the degree of dirt on the dishes is relatively high to select a sequence X (S2-4), drainage processing is performed on the basis of the contents of operations in the sequence X, after which the program proceeds to the rinsing process (S2-5 to S2-11). On the other hand, if the degree of dirt on the dishes is relatively low to select a sequence Y (S2-4), the program proceeds to the rinsing process without performing the processing in the steps S2-5 to S2-11 on the basis of the contents of operations in the sequence Y obtained by changing the contents of the operations in the sequence X.

12 Claims, 16 Drawing Sheets

| | | X | Y |
|---|---|---|---|
| WASHING | WATER SUPPLY | 30 SECONDS | THE SAME AS X |
| | WASHING | 30 SECONDS~ 3 MINUTES | |
| | STOP | 3 SECONDS | |
| | DRAINAGE | 20 SECONDS | |
| | WATER SUPPLY AND DRAINAGE | 10 SECONDS | (SKIP) |
| | STOP | 3 SECONDS | |
| | DRAINAGE | 12 SECONDS | |
| RINSING 1 | WATER SUPPLY | 30 SECONDS | THE SAME AS X |
| | RINSING | 30 SECONDS~ 3 MINUTES | |
| | STOP | 2 SECONDS | |
| | DRAINAGE | 20 SECONDS | |
| | WATER SUPPLY AND DRAINAGE | 10 SECONDS | (SKIP) |
| | STOP | 3 SECONDS | 3 SECONDS |
| | DRAINAGE | 12 SECONDS | 7 SECONDS |
| RINSING 2 | WATER SUPPLY | 30 SECONDS | THE SAME AS X |
| | RINSING | 1 MINUTE | |
| | STOP | 2 SECONDS | |
| | DRAINAGE | 20 SECONDS | |
| | WATER SUPPLY AND DRAINAGE | 10 SECONDS | (SKIP) |
| | STOP | 3 SECONDS | 3 SECONDS |
| | DRAINAGE | 12 SECONDS | 7 SECONDS |
| RINSING 3 | WATER SUPPLY | 30 SECONDS | THE SAME AS X |
| | RINSING | 1 MINUTE | |
| | STOP | 2 SECONDS | |
| | DRAINAGE | 30 SECONDS | |
| HOT WATER RINSING | WATER SUPPLY | 30 SECONDS | THE SAME AS X |
| | RINSING | | |
| | STOP | 2 SECONDS | |
| | WATER SUPPLY AND DRAINAGE | 60 SECONDS | |
| DRYING | DRYING | | THE SAME AS X |

FIG. 5

| | | X | Y |
|---|---|---|---|
| WASHING | WATER SUPPLY | 30 SECONDS | THE SAME AS X |
| | WASHING | 30 SECONDS~ 3 MINUTES | |
| | STOP | 3 SECONDS | |
| | DRAINAGE | 20 SECONDS | |
| | WATER SUPPLY AND DRAINAGE | 10 SECONDS | (SKIP) |
| | STOP | 3 SECONDS | |
| | DRAINAGE | 12 SECONDS | |
| RINSING 1 | WATER SUPPLY | 30 SECONDS | THE SAME AS X |
| | RINSING | 30 SECONDS~ 3 MINUTES | |
| | STOP | 2 SECONDS | |
| | DRAINAGE | 20 SECONDS | |
| | WATER SUPPLY AND DRAINAGE | 10 SECONDS | (SKIP) |
| | STOP | 3 SECONDS | 3 SECONDS |
| | DRAINAGE | 12 SECONDS | 7 SECONDS |
| RINSING 2 | WATER SUPPLY | 30 SECONDS | THE SAME AS X |
| | RINSING | 1 MINUTE | |
| | STOP | 2 SECONDS | |
| | DRAINAGE | 20 SECONDS | |
| | WATER SUPPLY AND DRAINAGE | 10 SECONDS | (SKIP) |
| | STOP | 3 SECONDS | 3 SECONDS |
| | DRAINAGE | 12 SECONDS | 7 SECONDS |
| RINSING 3 | WATER SUPPLY | 30 SECONDS | THE SAME AS X |
| | RINSING | 1 MINUTE | |
| | STOP | 2 SECONDS | |
| | DRAINAGE | 30 SECONDS | |
| HOT WATER RINSING | WATER SUPPLY | 30 SECONDS | THE SAME AS X |
| | RINSING | | |
| | STOP | 2 SECONDS | |
| | WATER SUPPLY AND DRAINAGE | 60 SECONDS | |
| DRYING | DRYING | | THE SAME AS X |

DISH WASHING MACHINE

BACKGROUND OF THE INVENTION

1. Field of the Invention

The present invention relates to a dish washing machine for automatically washing and rinsing, for example, the dishes contained in a cavity.

2. Description of the Prior Art

A dish washing machine so adapted as to spray wash water on the dishes contained in a cavity to wash the dishes and dry in the cavity the dishes which have been washed is disclosed in Japanese Patent Laid-Open Gazette No. 48724/1985, for example.

This type of dish washing machine is so constructed that a part of the sidewall of a water suction pipe provided between a water storage chamber provided on the bottom of a cavity and the water suction side of a nozzle pump is made of a translucent material, and a light emitting element and a light receiving element for detecting the light transmittance of a liquid in the water suction pipe are disposed on the outside of the translucent sidewall, to control the time when each of the washing, rinsing, dehydrating and drying processes is terminated at the time point where the amount of light received by the light receiving element does not change.

In the dish washing machine disclosed in Japanese Patent Laid-Open Gazette No. 48724/1985 is so adapted as to measure the change in the transmittance and detect the time when the transmittance does not change to terminate each of the washing, rinsing, dehydrating and drying processes, as described above.

In the above described dish washing machine, however, the washed state of dirt adhering to the dishes is detected, while sequence control corresponding to the quality of the dirt is not carried out. Therefore, an oil film or the like may remain on the dishes which have been washed.

Therefore, a dish washing machine so adapted as to change the washing time and the washing temperature depending on the amount of dirt and the quality of dirt on the dishes has been proposed in Japanese Patent Laid-Open Gazette No. 49584/1993 by the applicant of the present invention.

In this dish washing machine, however, the contents themselves of washing and rinsing are the same, although the washing time and the washing temperature change depending on the degree of dirt on the dishes. Specifically, the dish washing machine includes processing for draining wash water at the same time that the wash water is supplied during washing and rinsing operations irrespective of the degree of dirt on the dishes to cause garbage accumulated on the bottom of a cavity to flow out. In addition, the dish washing machine includes processing for draining wash water at the same time that the wash water is supplied irrespective of the degree of dirt on the dishes during the washing and rinsing operations, stopping the washing and rinsing operations, and then draining the wash water for a predetermined time period to almost terminate the drainage of the dirty wash water, after which the subsequent rinsing operation can be performed using clean wash water. If the above described processing is not required because the degree of dirt on the dishes is low, therefore, it has become clear that water is uselessly used.

SUMMARY OF THE INVENTION

The present invention has been made in view of the above described technical problems and has for its object to provide a dish washing machine in which the contents of washing and/or the contents of rinsing are changed depending on dirt on the dishes, and water is prevented from being uselessly used particularly if the degree of dirt on the dishes is low.

Another object of the present invention is to provide a dish washing machine in which time required to wash the dishes can be shortened if the degree of dirt on the dishes is low.

According to the present invention, the dishes are washed on the basis of the sequence of the contents of processing corresponding to the degree of dirt on the dishes. Particularly if the degree of dirt on the dishes is low, therefore, it is possible to prevent water from being uselessly used as well as shorten time required to wash the dishes.

The foregoing and other Objects, features, aspects and advantages of the present invention will become more apparent from the following detailed description of the present invention when taken in conjunction with the accompanying drawings.

BRIEF DESCRIPTION OF THE DRAWINGS

FIG. 5 is a diagram of sequence X and sequence Y stored in the control circuit.

DETAILED DESCRIPTION OF THE PREFERRED EMBODIMENTS

Figure 1:
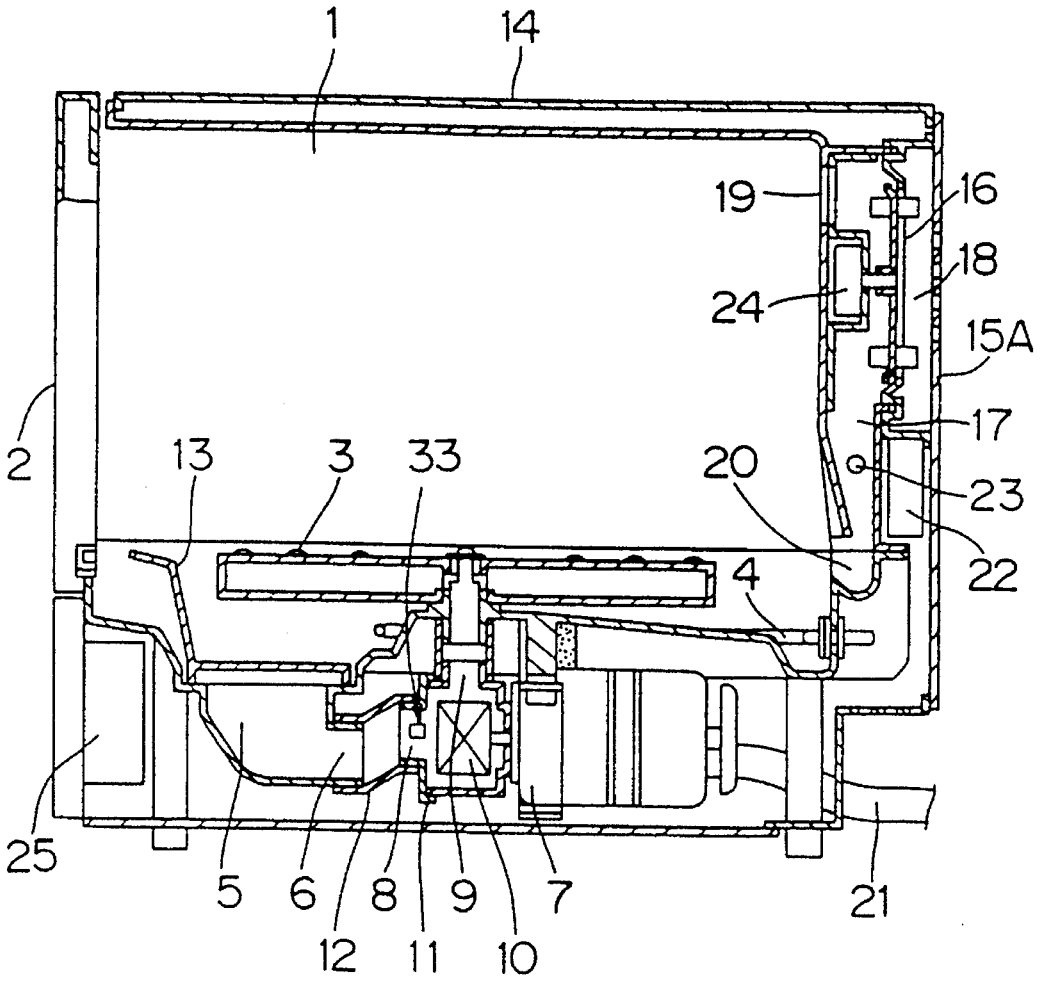
FIG. 1 is a longitudinal sectional view showing the entire construction of a dish washing and drying machine according to one embodiment of the present invention.

FIG. 1 is a longitudinal sectional view showing a dish washing and drying machine according to one embodiment of the present invention.

Referring to FIG. 1, a dish washing and drying machine according to the present embodiment comprises a cavity 1 containing the dishes, a nozzle 3 rotatably attached to the center of a bottom surface of the cavity 1, a water supply valve 22 provided on a rear surface of the cavity 1 for supplying wash water to the cavity 1, a pump 7 mounted on an outer bottom surface of the cavity 1 for feeding the wash water into the nozzle 3 to spray the wash water on the dishes, a heater 4 disposed on the bottom surface of the cavity 1 for heating the wash water in the cavity 1, a transmittance detecting device 33 for detecting the light transmittance of the wash water, and a control section 25 for controlling the sequence of washing, rinsing and drying.

The cavity 1 is formed in the shape of a box having an opening for containing the dishes in its front surface. A door 2 for closing the opening is attached to a front portion of the cavity 1 so as to be freely opened or closed. In addition, the cavity 1 is covered with an outer tank 14. A water storing section 5 is formed in a front portion of the bottom of the cavity 1. A filter 13 for removing garbage contained in the wash water is disposed above the water storing section 5, and a discharge port 6 for discharging the wash water is provided from the bottom of the water storing section 5 to the side thereof.

A rear face plate 15A is attached to the rear of the outer tank 14 spaced a predetermined distance apart from the rear surface of the cavity 1. A circulating air duct 17 and a cooling air duct 18 partitioned by a double faced fan 16 are provided between the rear face plate 15A and the cavity 1. The double faced fan 16 is rotated by a motor 24. The circulating air duct 17 is formed in communication with an air outlet 19 provided in the upper portion of the rear surface of the cavity 1 and an air inlet 20 provided in the lower portion thereof. Air in the cavity 1 is forcedly exhausted from the air outlet 19 to the circulating air duct 17 by the double faced fan 16. Furthermore, air heat-exchanged and dehumidified is taken in to the cavity 1 from the air inlet 20 by the double faced fan 16.

The water supply valve 22 is connected to a water supply port 23 provided for the circulating air duct 17.

The pump 7 comprises a pump casing 11 having an inlet 8, an outlet 9 and an impeller 10. The pump 7 functions as a washing pump and a drainage pump. Specifically, the pump 7 feeds the wash water into the nozzle 3 from the outlet 9 of the pump casing 11 when it is rotated in the forward direction, to spray the wash water to the dishes in the cavity 1. On the other hand, the pump 7 drains the wash water in the cavity 1 outward through a drainage pipe 21 when it is rotated in the reverse direction. In addition, the position of the inlet 8 of the pump casing 11 is set higher than the discharge port 6 of the water storing section 5 by, for example, 15 mm, so that the step is provided between the inlet 8 and the discharge port 6.

The inlet 8 and the discharge port 6 of the water storing section 5 are connected to each other by a pipe 12 made of rubber. Although the pump 7 is a washing and drainage pump in the present embodiment, a washing pump and a drainage pump may be separately provided.

Figure 2:
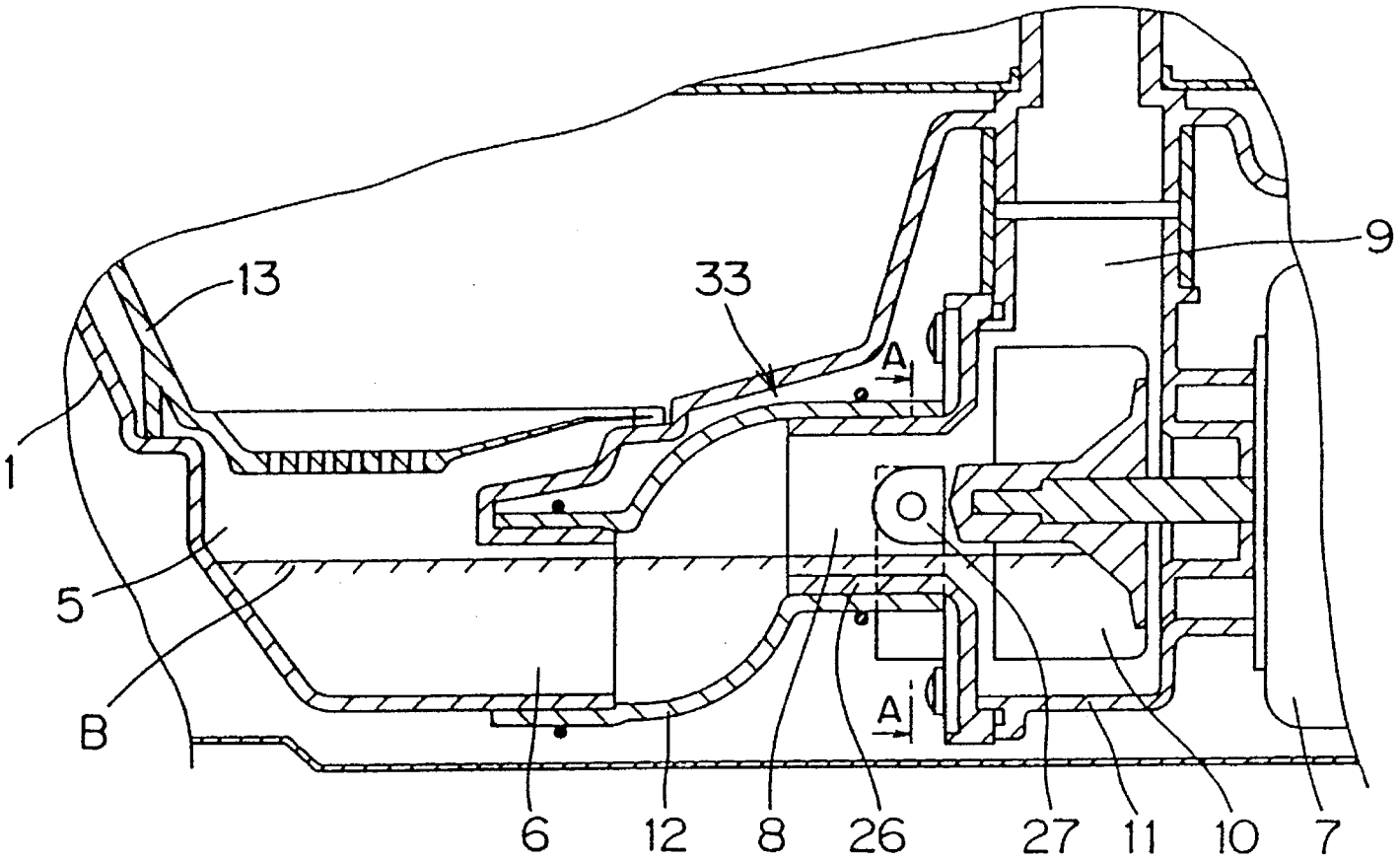
FIG. 2 is a enlarged sectional view showing the bottom of a cavity of the dish washing and drying machine according to one embodiment of the present invention.

FIG. 2 is an partially enlarged view showing the bottom of the cavity in the dish washing and drying machine shown in FIG. 1. In addition, FIG. 3 is a cross sectional view taken along a line A—A shown in FIG. 2.

Figure 3:
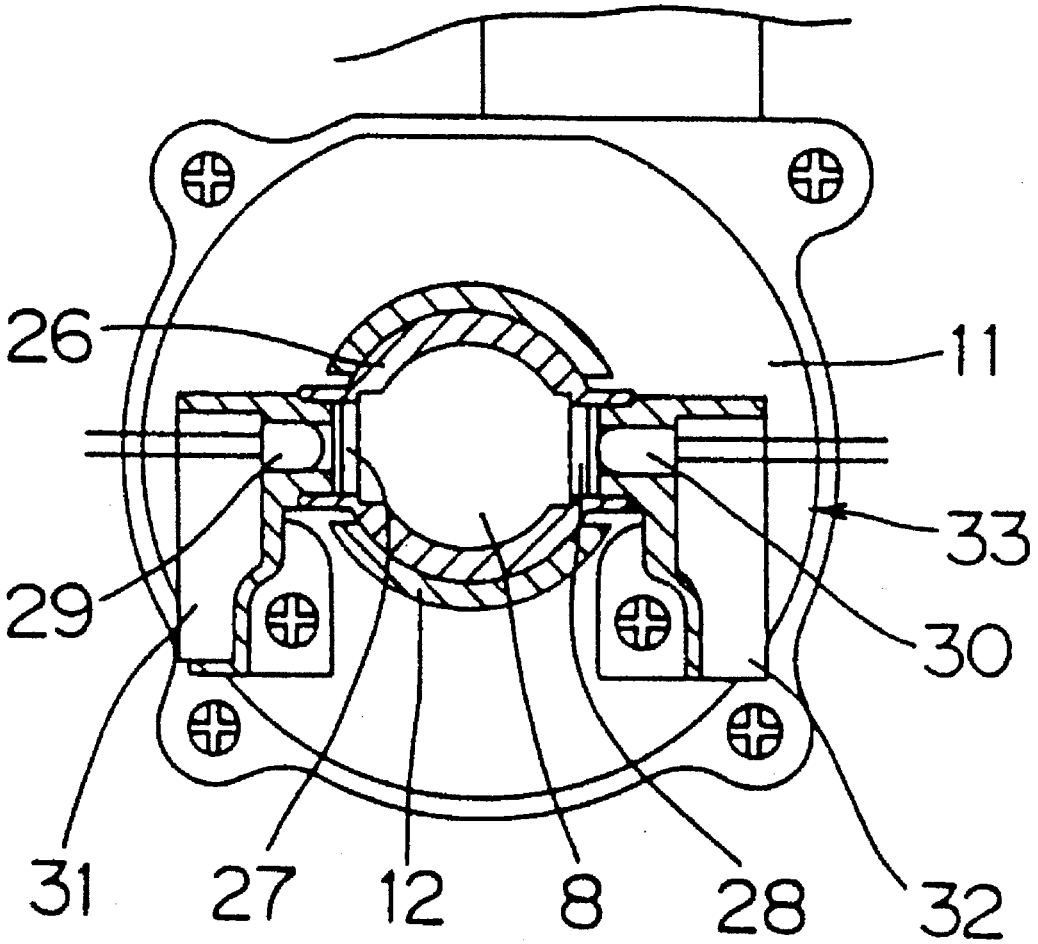
FIG. 3 is a cross sectional view taken along a line A—A shown in FIG. 2.

Referring to FIGS. 2 and 3, the transmittance detecting device 33 comprises an emitted light transmitting section 27 provided on a left side wall of a connecting section 26 for the pipe 12 provided for the inlet 8 of the pump casing 11 as viewed toward the inlet 8 and made of a transparent member, a received light transmitting section 28 provided on a right side wall of the connecting section 26 so as to be opposed to the emitted light transmitting section 27 and made of a transparent member, a light emitting element 29 such as a diode for emitting light to the inlet 8 through the emitted light transmitting section 27, a light receiving element 30 such as a phototransistor for receiving the light emitted from the light emitting element 29 through the received light transmitting section 28, a light emitting element mounting section 31 screwed into the pump casing 11 so as to fix the light emitting element 29 to the emitted light transmitting section 27 of the connecting section 26, and a light receiving element mounting section 32 screwed into the pump casing 11 so as to fix the light receiving element 30 to the received light transmitting section 28.

The dish washing and drying machine according to the present invention is so constructed that the inlet 8 of the pump casing 11 is opened sideward so as to keep the height thereof small. If wash water is drained to some extent, therefore, air is mixed with the wash water sucked in by the pump 7, thereby to enter a state where the wash water cannot be further drained. The wash water which cannot be drained remains as remaining water in the water storing section 5, the pipe 12, and the pump casing 11. At this time, the pump 7 is so attached that the inlet 8 of the pump casing 11 is higher than the discharge port 6 of the water storing section 5, whereby the surface of the remaining water is in a position indicated by B in FIG. 2. Consequently, the emitted light transmitting section 27 and the received light transmitting section 28 are above the surface of the remaining water B, not to be dipped in the remaining water and not to be clouded due to dirt of the remaining water. In addition, there is no degradation of light transmission properties by the adhesion of water scale.

Figure 4:
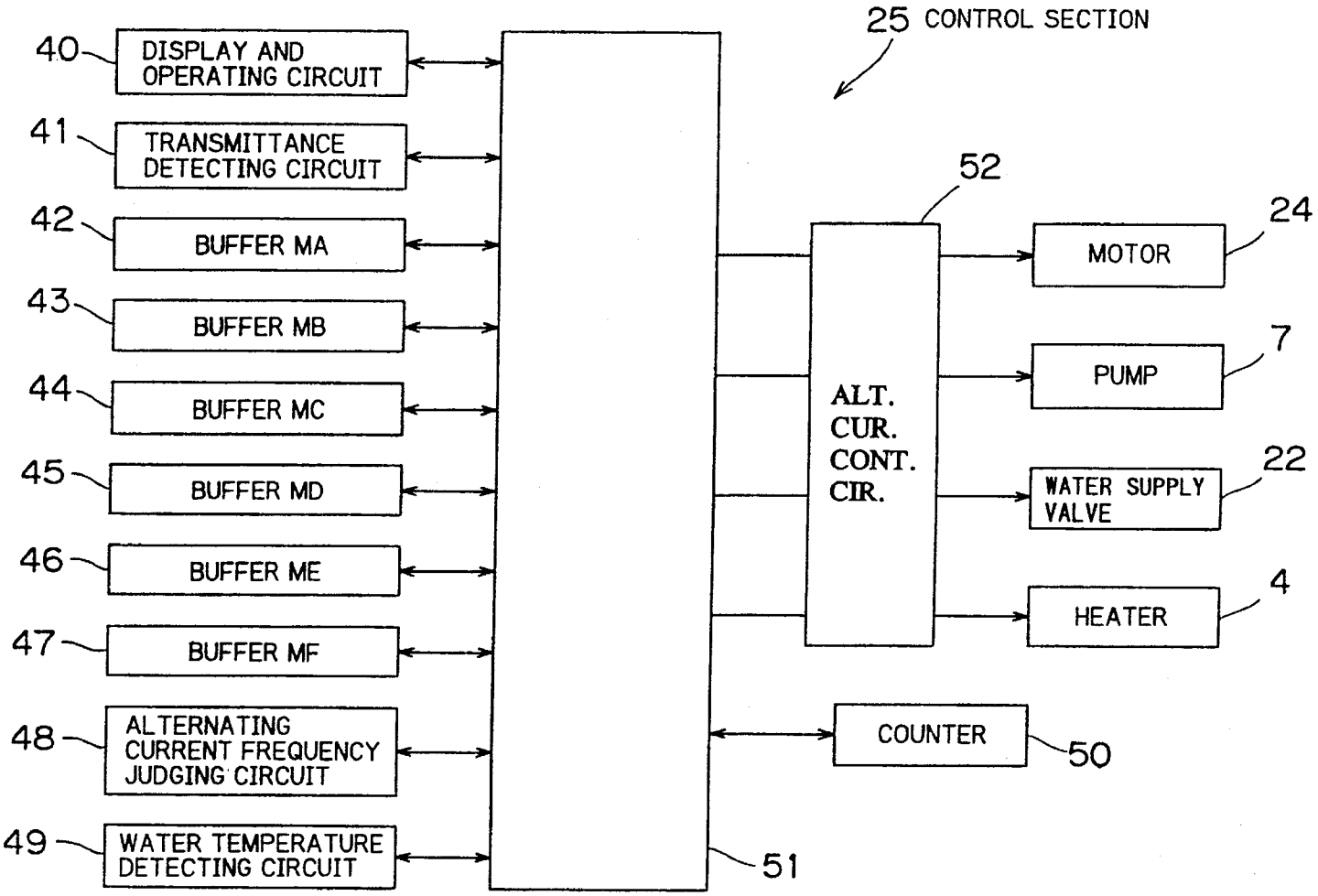
FIG. 4 is a block diagram showing an electricity-related device of the dish washing and drying machine according to one embodiment of the present invention.

The electrical construction of the control section 25 will be described with reference to a block diagram of FIG. 4.

The control section 25 comprises a display and operating circuit 40, a transmittance detecting circuit 41 for detecting light transmittance on the basis of an output signal from the light receiving element 30 in the transmittance detecting device 33, a buffer MA 42, a buffer MB 43, a buffer MC 44, a buffer MD 45, a buffer ME 46 and a buffer MF 47 which store values detected by the transmittance detecting circuit 41, an alternating current frequency judging circuit 48 for judging the frequency of the commercial power supply, a water temperature detecting circuit 49 for detecting the temperature of wash water on the basis of an output signal from a temperature-sensing element such as a thermistor, a counter 50 for counting washing time, rinsing time and drying time, and a control circuit 51.

The control circuit 51 has a microcomputer including a CPU, a ROM, a RAM and the like. A heater 4, a pump 7, a water supply valve 22 and a motor 24 are connected to the control circuit 51 through an alternating current control circuit 52. The control circuit 51 controls the motor 24, the pump 7, the water supply valve 22, and the heater 4 on the basis of the values detected by the transmittance detecting circuit 41.

Furthermore, the control circuit 51 stores a sequence X and a sequence Y shown in FIG. 5. The sequence X corresponds to a case where the degree of dirt on the dishes is relatively high, and the sequence Y corresponds to a case where the degree of dirt on the dishes is relatively low. Processes of washing (water supply (30 seconds) → washing (30 seconds to 3 minutes)→ stop (3 seconds)→ drainage (20 seconds)→ water supply and drainage (10 seconds)→ stop (3 seconds)→ drainage (12 seconds)), rinsing 1 (water supply (30 seconds)→ rinsing (30 seconds to 3 minutes)→ stop (2 seconds)→ drainage (20 seconds)→ water supply and drainage (10 seconds)→ stop (3 seconds)→ drainage (12 seconds)), rinsing 2 (water supply (30 seconds)→ rinsing (1 minute)→ stop (2 seconds)→ drainage (20 seconds)→ water supply and drainage (10 seconds)→ stop (3 seconds)→ drainage (12 seconds)), rinsing 3 (water supply (30 seconds)→ rinsing (1 minute)→ stop (2 seconds)→ drainage (30 seconds)), hot water rinsing (water supply (30 seconds)→ rinsing→ stop (2 seconds)→ water supply and drainage (60 seconds)) and drying are set in the sequence X.

On the other hand, processes of washing (water supply (30 seconds)→ washing (30 seconds to 3 minutes)→ stop (3 seconds)→ drainage (20 seconds)), rinsing 1 (water supply (30 seconds)→ rinsing (30 seconds to 3 minutes)→ stop (2 seconds)→ drainage (20 seconds)→ stop (3 seconds)→ drainage (7 seconds)), rinsing 2 (water supply (30 seconds)→ rinsing (1 minute)→ stop (2 seconds)→ drainage (20 seconds) → stop (3 seconds)→ drainage (7 seconds)), rinsing 3 (water supply (30 seconds)→ rinsing (1 minute)→ stop (2 seconds)→ drainage (30 seconds)), hot water rinsing (water supply (30 seconds)→ rinsing→ stop (2 seconds)→ water supply and drainage (60 seconds)) and drying are set in the sequence Y.

The reason why wash water is drained at the same time that the wash water is supplied in the latter part of the washing process as described above is that the degree of dirt on the dishes is relatively high and a lot of garbage or the like is accumulated on the bottom of the cavity, so that the accumulated garbage or the like must be caused to flow out. Thereafter, the washing process is stopped once for three seconds in order to store dirty wash water adhering to the dishes or the wall surface of the cavity in the water storing section once. The dirty wash water stored in the water storing section is almost completely drained by the drainage for 12 seconds. As a result, the inside of the cavity is cleaned. That is, the foregoing series of operations peculiar to the sequence X is performed in order to enhance the rinsing effect in such a manner that water for the rinsing process following the washing process is not dirty.

On the other hand, the sequence Y does not include the foregoing operations of simultaneous water supply and drainage, stop and drainage in the latter part of the washing process. The reason for this is that the degree of dirt on the dishes is relatively low and garbage or the like is hardly accumulated on the bottom of the cavity. If the degree of dirt on the dishes is relatively low, the rinsing effect can be sufficiently obtained even if the operations of draining wash water at the same time that the wash water is supplied, stopping the washing process, and then draining the wash water are not included in the latter part of the washing process.

Furthermore, in the sequence X, an operation of draining wash water at the same time that the wash water is newly supplied is performed in the latter part of each of the rinsing 1 process and the rinsing 2 process. An object of the operation is to newly spray wash water on the dishes the degree of dirt of which is high, and drain the wash water, thereby to wash away the dirty wash water adhering to the surfaces of the dishes and the inner wall of the cavity. After the wash water is simultaneously supplied and drained, the rinsing process is stopped once for three seconds, for example, and the wash water is drained for 12 seconds, for example, in order to almost completely drain the wash water adhering to the dishes and the inner wall of the cavity and dropped. Consequently, rinsing water the degree of dirt of which is low can be used in the subsequent rinsing process. Accordingly, the subsequent rinsing process can be effectively carried out.

On the other hand, in the sequence Y, the operation of simultaneous water supply and drainage is not included in the latter part of each of the rinsing 1 process and the rinsing 2 process. That is, in the rinsing 1 process and the rinsing 2 process in the sequence Y, operations of water supply, rinsing, stop and drainage are performed in this order, after which the rinsing process is stopped for three seconds, for example, and the wash water is drained as additional drainage for seven seconds. In a time period of seven seconds for the last additional drainage, almost all of the dirty wash water in the cavity is drained. In the rinsing 1 process and the rinsing 2 process in the sequence Y, the operation of draining wash water at the same time that the wash water is newly supplied is not included in the latter part of each of the processes. The reason for this is that the sequence Y corresponds to a case where the degree of dirt on the dishes is relatively low. If the degree of dirt on the dishes is relatively low, the dirty wash water hardly adheres to the surfaces of the dishes and the inner wall of the cavity. Therefore, it is not necessary to simultaneously supply and drain wash water to wash away dirty wash water adhering to the surfaces of the dishes and the inner wall of the cavity.

If the sequence Y in which particular operations are omitted is carried out in a case where the degree of dirt on the dishes is thus relatively low, it is possible to reduce the amount of wash water used to prevent water from being uselessly used. Further, it is possible to shorten the operating time.

In the present embodiment, in each of the rinsing 1 process and the rinsing 2 process in the sequence Y, the drainage operation is performed for 20 seconds, after which the rinsing process is stopped for three seconds, and the additional drainage operation is performed for seven seconds. However, a stopping time period of three seconds may be omitted in some instances.

Figure 6:
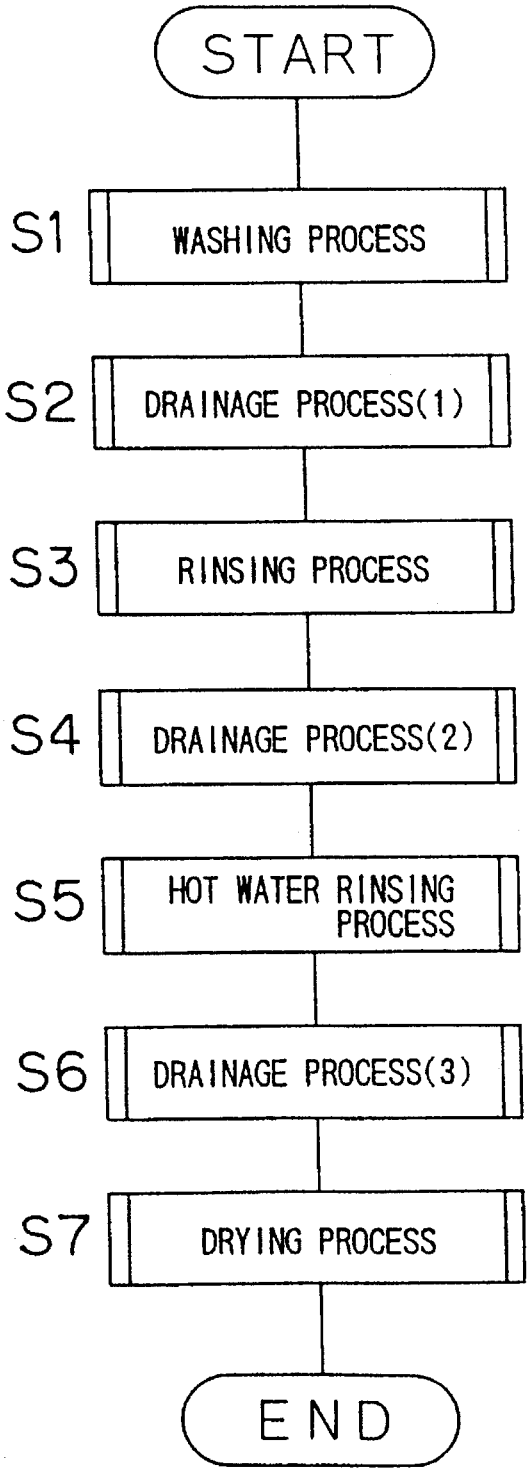
FIG. 6 is a flow chart showing the enter processes of the dish washing machine.

FIG. 6 is a flow chart showing the enter processes of the dish washing machine.

Referring to FIG. 6, the dish washing machine is started, after which the washing process is first carried out in the step S1. If the washing process is terminated, the drainage process (1) is carried out in the step S2, and then the ringing process is carried out in the step S3. If the rinsing process is terminated, the drainage process (2) is carried out in the step S4, and the hot water rinsing process is carried out in the step S5. If the hot water rinsing process is terminated, the drainage process (3) is carried out in the step S6, and the drying process is carried out in the step S7, to terminate the processes.

The operation of the dish washing and drying machine according to the present embodiment will be described with reference to flow charts of FIGS. 7 through 10.

Figure 7:
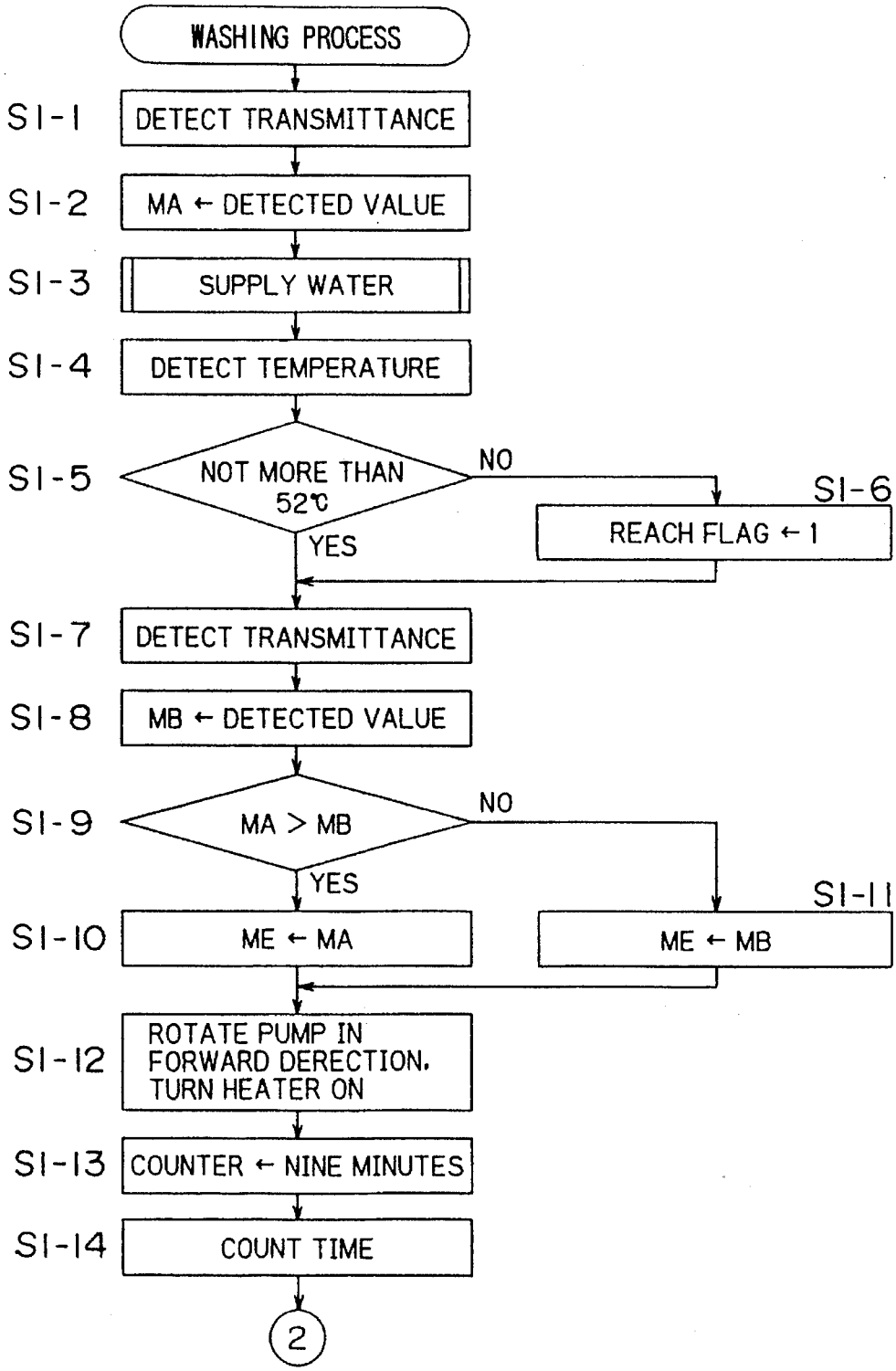
FIGS. 7, 8, 9 and 10 are flow charts showing operations in the washing process in the dish washing and drying machine according to one embodiment of the present invention.
Figure 8:
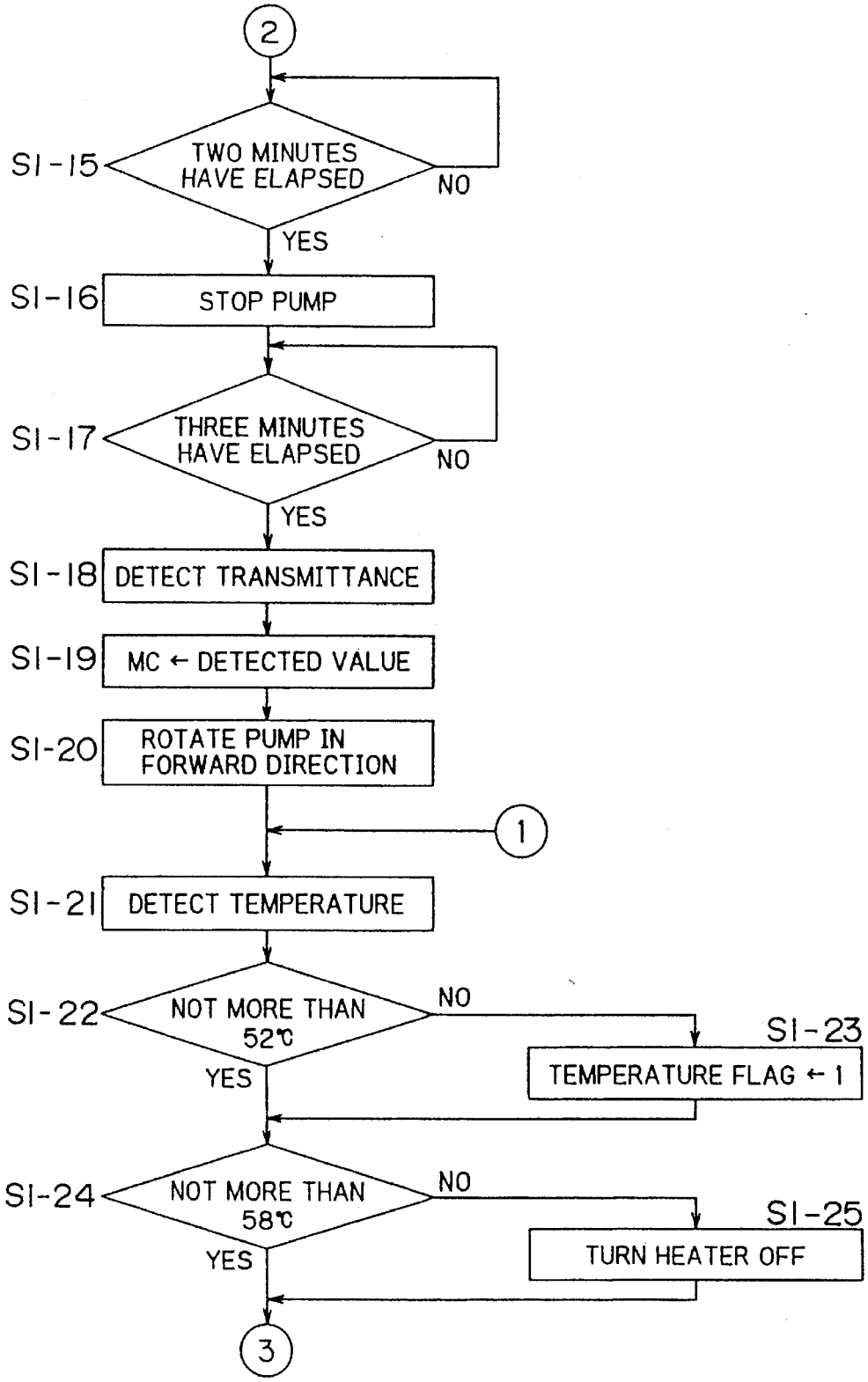
Figure 9:
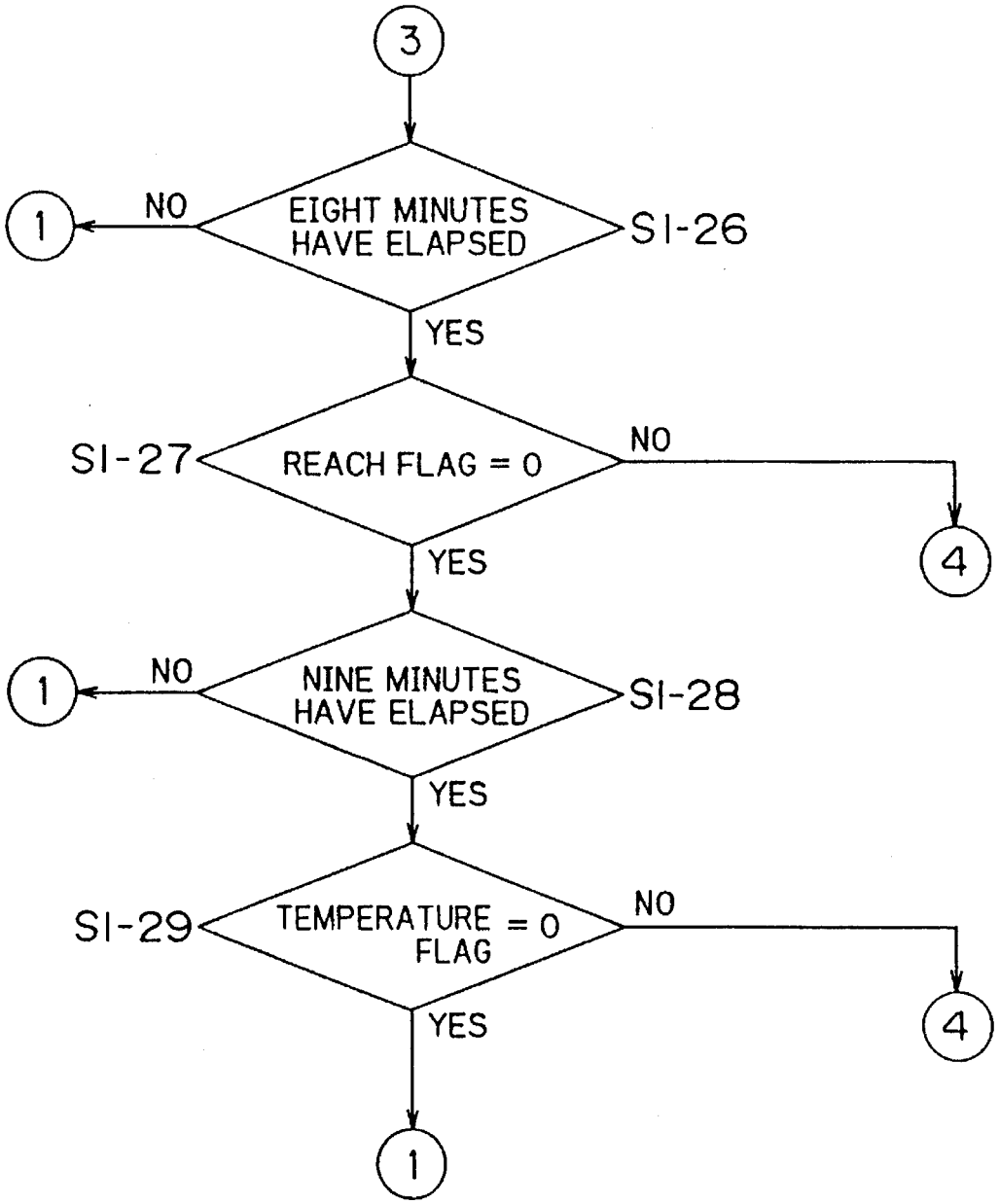

Refering to FIG. 7, if the operation is started, in the step S-1, light transmittance of wash water is detected by the transmittance detecting circuit 41 on the basis of an output signal from the light receiving element 30 in the step S1-1. Specifically, the transmittance before the water supply to the cavity 1 is detected (this detected value is outputted as a voltage, which is, for example, 5 V if the condition is normal). The value before the water supply which is detected in the step S1-1 is stored in the buffer MA 42 in the step S1-2 and then, the water supply valve 22 is opened to supply a predetermined amount of wash water to the cavity 1 in the step S1-3. If the predetermined amount of wash water is supplied, the program proceeds to the step S1-4. In the step S1-4, the temperature of the supplied wash water is detected by the water temperature detecting circuit 49. At this time, if the detected temperature is not more than 52° C., the program proceeds to the step S1-7. On the other hand, if the temperature exceeds 52° C., a reach flag is set to "1" in the step S1-6 and then, the program proceeds to the step S1-7. Since it is generally water at ordinary temperature that is supplied to the cavity 1, the step S1-6 is skipped in many If the program proceeds to the step S1-7, the light transmittance of the wash water is detected by the transmittance detecting circuit 41. Specifically, the light transmittance of the wash water before the start of the washing operation is detected. The transmittance before the start of the washing operation is generally approximately equal to the transmittance before the water supply, that is, approximately 5 V. The value before the start of the washing operation is stored in the buffer MB 43 in the step S1-8.

In the step S1-9, the value MA before the water supply which is stored in the buffer MA 42 and the value MB before the start of the washing operation after the water supply which is stored in the buffer MB 43 are compared with each other. The value MA is stored in the buffer ME 46 in the step S1-10 if MA>MB, while the value MB is stored in the buffer ME 46 in the step Sl-11 if MA<MB. Specifically, the higher one of the first transmittance MA which is detected in the step S1-1 and the transmittance MB before the start of the washing operation after the water supply which is detected in the step S1-7 is stored in the buffer ME 46 as an initial value in the steps S1-10 and S1-11 and then, the program proceeds to the step S1-12.

In the present embodiment, 5 V is outputted as a voltage representing the initial transmittance in a case where the condition of dirt of the wash water is normal from the transmittance detecting device 33. As described above, the value MA before the water supply which is detected in the step S1-1 and the value MB before the start of the washing operation after the water supply which is detected in the step S1-7 are approximately equal to each other, that is, 5 V, so that the transmittance is approximately 100%. Therefore, both the values MA and MB are hardly changed.

However, garbage at the time of the previous washing may, in some cases, adhere to a light path from the light emitting element 29 to the light receiving element 30 in the transmittance detecting device 33. In such a case, the value MA before the water supply which is detected in the step S1-1 is extremely low. If the wash water is supplied to the cavity 1, however, the garbage is suspended in the wash water, so that no garbage is left in the light path from the light emitting element 29 to the light receiving element 30 in many cases. Accordingly, a normal value, for example, 5 V is obtained as MB in the step S1-7. On the other hand, the value MA which is detected in the step S1-1 is 5 V. However, the garbage may, in some cases, accidentally intercepts the light received by the light receiving element 30 by supplying the wash water so that the value MB which is detected in the step S1-7 is significantly lowered.

In the present embodiment, the transmittance before the water supply and the transmittance before the start of the washing operation after the water supply are detected to select the correct one, that is, the higher one of values of the transmittance in consideration of such a phenomenon sometimes occurring that garbage intercepts light.

Furthermore, the light emitting element 29 or the light receiving element 30 in the transmittance detecting device 33 is gradually degraded in performance as it is used. Therefore, the value which is detected in the step S1-1 or the value which is detected in the step S1-7 is gradually lowered due to the change with time even if light is not intercepted by garbage or the like. When the amount of dirt and the quality of dirt are calculated as described later, therefore, the above described value detected in the step S1-1 or S1-7 is utilized so as to compensate for the degradation with the use.

The pump 7 is rotated in the forward direction so that the washing operation is started and the heater 4 is turned on in the step S1-12, time data "nine minutes" is inputted to the counter 50 in the step S1-13, and time starts to be counted in the step S1-14. Thereafter, the program proceeds to the steps in FIG. 8.

It is judged in the step S1-15 whether or not two minutes have elapsed since the washing operation was started. If two 5 minutes have elapsed since the washing operation was started, the program proceeds to the step S1-16. In the step S1-16, the pump 7 is stopped. In addition, it is judged in the step S1-17 whether or not three minutes have elapsed since the washing operation was started. If three minutes have elapsed since the washing operation was started, that is, one minute has elapsed since the pump 7 was stopped, the program proceeds to the step S1-18. In the step S1-18, the light transmittance of the wash water is detected by the transmittance detecting circuit 41. In the step S1-19, the value detected in the step S1-18 is stored in the buffer MC 44. The pump 7 is then rotated in the forward direction again in the step S1-20 and then, the program proceeds to the step S1-21.

The reason why the pump 7 is stopped in detecting the light transmittance of the wash water after the washing operation is started in the above described steps S1-15 through S1-20 is as follows.

If the light transmittance is detected with the pump 7 being driven, there are the following possibilities:

a) At the time of washing, a detergent is contained in the wash water. If the wash water is agitated by driving the pump 7, therefore, bubbles of the detergent are formed. In addition, if air is taken in while the pump 7 is being driven and consequently, the air is contained in the wash water, cavitation is encountered, to form bubbles. The formation of the bubbles makes it impossible to accurately detect the light transmittance of the wash water itself.

b) While the pump 7 is being driven, the wash water is agitated, and garbage or the like dropped from the dishes is suspended in the wash water. Accordingly, the garbage or the like interrupts light between the light emitting element 29 and the light receiving element 30 in the transmittance detecting device 33, thereby to make it impossible to accurately detect the light transmittance of the wash water itself.

In the present embodiment, therefore, the light transmittance of the wash water is detected after the pump 7 is stopped one minute before the transmittance is detected, so that the bubbles in the wash water disappear and the garbage or the like sinks into the lower part of the wash water. Consequently, it is possible to accurately detect the condition of dirt of the wash water itself.

If the program proceeds to the step S1-21, the temperature of the wash water is detected. In the step S1-22, it is judged whether or not the temperature of the wash water is not more than 52° C. The program proceeds to the step S1-24 if the temperature of the water is not more than 52° C., while a temperature flag is set to "1" in the step S1-23 and then, the program proceeds to the step S1-24 if the temperature exceeds 52° C. In the step S1-24, it is judged whether or not the temperature of the wash water is not more than 58° C. The program proceeds to the step S1-26 shown in FIG. 9 if the temperature of the water is not more than 58° C., while the heater 4 is turned off in the step S1-25 and then, the program proceeds to the step S1-26 if the temperature exceeds 58° C.

If the program proceeds to the step S1-26, it is judged whether or not eight minutes have elapsed since the washing operation was started. If eight minutes have elapsed since the washing operation was started, the program proceeds to the step S1-27. In the step S1-27, the reach flag is detected. The program proceeds to the process in FIG. 10 if the reach flag is set to "1", that is, the supplied wash water exceeds 52° C., while proceeding to the step S1-28 if the reach flag is "0". In the step S1-28, it is judged whether or not one minute has further elapsed that is, nine minutes have elapsed since the washing operation was started. If nine minutes have elapsed since the washing operation was started the program proceeds to the step S1-29. In the step S1-29, the temperature flag is detected. If the temperature flag is set to "1" that is, the supplied wash water exceeds 52° C. the program proceeds to the process in FIG. 10. On the other hand, if the temperature flag is "0", that is, the wash water is not more than 52° C., the washing operation is continued, to repeat the processing in the step S1-21 and the subsequent steps.

Figure 10:
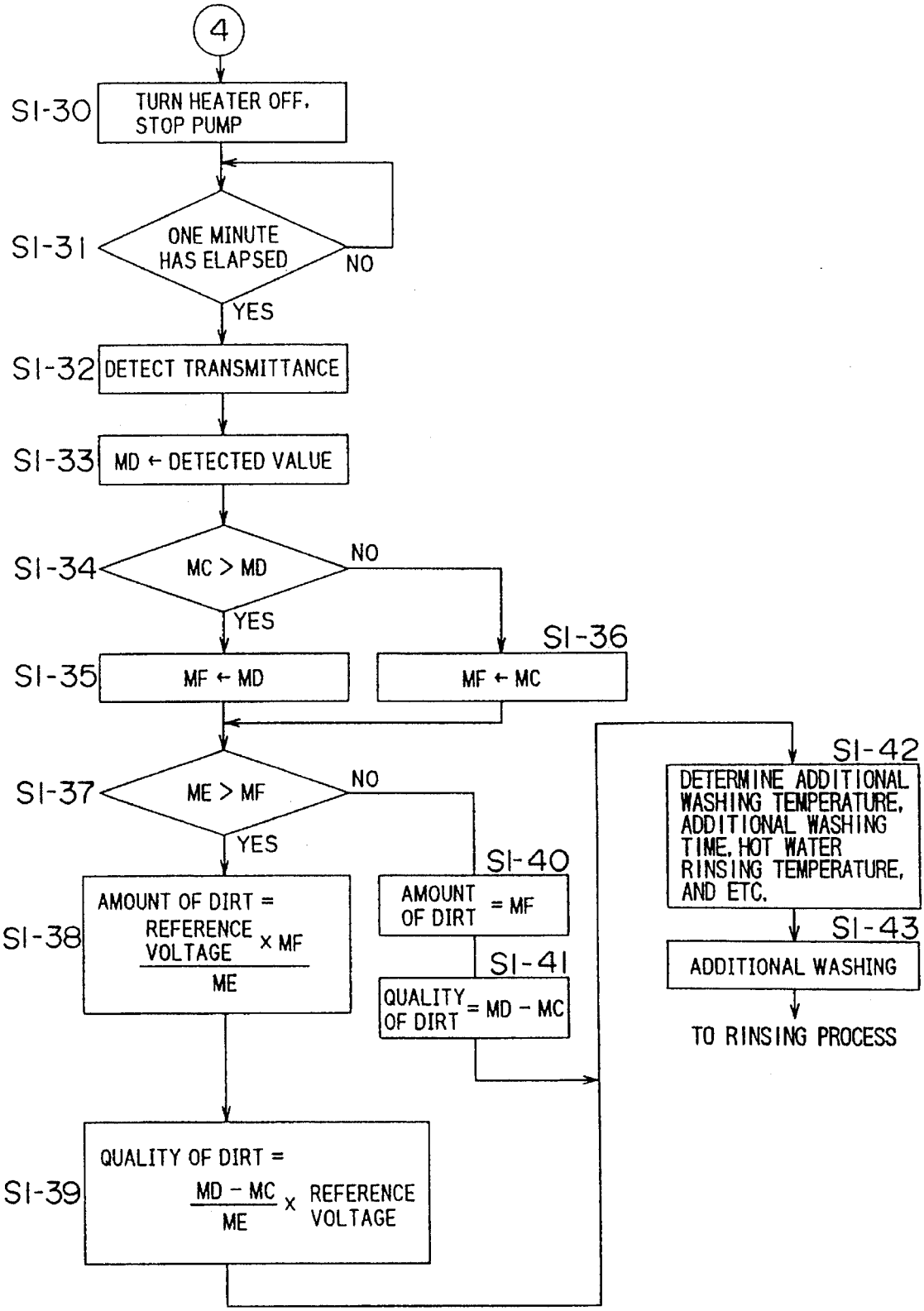

If the process in FIG. 10 is started, the pump 7 and the heater 4 are first turned off in the step S1-30, and it is judged in the step S1-31 whether or not one minute has elapsed since the pump 7 and the heater 4 were turned off, as shown in FIG. 10. If one minute has elapsed the program proceeds to the step S1-32. In the step S1-32, the light transmittance of the wash water is detected in the transmittance detecting circuit 41. In the step S1-33, the value detected in the step S1-32 is stored in the buffer MD 45. Also in this case, the pump 7 and the heater 4 are temporarily turned off before the light transmittance of the wash water is detected in order to cause the bubbles in the wash water to disappear and cause the garbage or the like in the wash water to sink so that the light transmittance of the wash water is correctly detected.

Thereafter, the value MC stored in the buffer MC 44 and the value MD stored in the buffer MD 45 are compared with each other in the step S1-34. Specifically, the voltage MC representing transmittance at the time when three minutes which are a predetermined short time period have elapsed since the washing operation was started (the actual washing time is two minutes) and the voltage MD representing transmittance at a certain time point after performing the washing operation for at least eight minutes are compared with each other. The value MD is stored in the buffer MF 47 in the step S1-35 if MC>MD, while the value MC is stored in the buffer MF 47 in the step S1-36 if MC≦MD. Specifically, the lower one of the voltage MC representing the transmittance at the time when a predetermined short time period has elapsed since the washing operation was started and the voltage MD representing the transmittance after performing the washing operation for a relatively long time period is stored as MF in the buffer MF 47 in the steps S1-35 and S1-36. Thereafter, the program proceeds to the step S1-37.

In the step S1-37, an initial value ME in the buffer ME 46 and the value MF (the lower one of MC and MD) in the buffer MF 47 are compared with each other.

If the voltage ME representing transmittance before starting the washing operation and the voltage MF representing the transmittance after performing the washing operation for a predetermined time period are compared with each other, the voltage MF after performing the washing operation is generally lower. The reason for this is that dirt on the dishes is mixed with the wash water by the washing operation, so that the transmittance of the wash water is lowered. Consequently, ME is generally higher than MF.

Accordingly, the amount of dirt is then calculated on the basis of the following equation (1) in the step S1-38:

$$\text{Amount of dirt}=MF\times(\text{Reference voltage}/ME) \quad (1)$$

In the equation, "Reference voltage" means a voltage outputted from the transmittance detecting circuit 41 when the transmittance is 100% in a case where the dish washing and drying machine is new, that is, 5 V. The voltage ME is also 5 V when the light receiving element 30 is not degraded as it is used, while being slightly lower than 5 V if the light receiving element 30 is degraded. Therefore, the change with time of the light receiving element 30 is corrected by the foregoing equation (1).

The quality of dirt is then calculated by the following equation (2) in the step S1-39.

$$\text{Quality of dirt}=(MD-MC)\times(\text{Reference voltage}/ME) \quad (2)$$

The quality of dirt is represented by the difference between the voltage MC at the time when a short time period has elapsed since the washing operation was started and the voltage MD after performing the washing operation for at least eight minutes. Also in this case, the ratio of the reference voltage to the initial detected voltage ME is multiplied so as to correct the change with time of the light receiving element 30.

Unless ME is higher than MF in the step S1-37, the initial value ME may not be an accurate value because light is intercepted by, for example, garbage or the like, so that processing for correcting the change with time of the light receiving element 30 using the initial value ME and the reference voltage is not performed. In this case, the initial value ME is ignored, to determine the amount of dirt and the quality of dirt. Specifically, it is determined that the amount of dirt is MF and the quality of dirt is (MD–MC) in the steps S1-40 and S1-41. Thereafter, the program proceeds to the step S1-42.

In the step S1-42, the additional washing temperature, the additional washing time, the rinsing time, the hot water rinsing temperature, the drying time, and the type of drainage process are determined by fuzzy inference. Thereafter, an additional washing operation is performed in the step S1-43, after which the program proceeds to the rinsing process.

The reason why the amount of dirt and the quality of dirt can be detected from the light transmittance of wash water will be described with reference to FIGS. 13 and 14.

Figure 13:
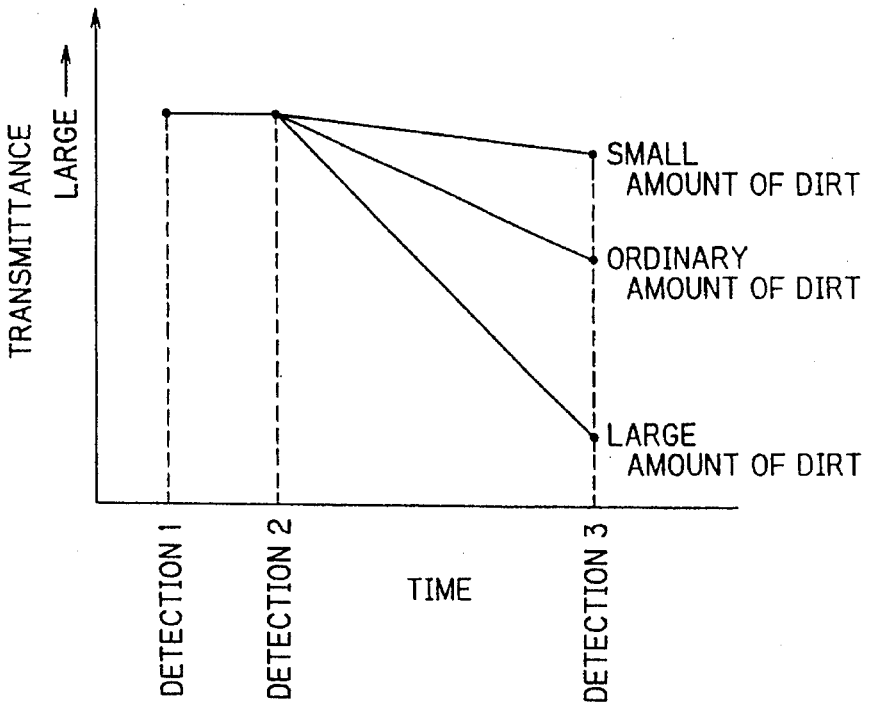
FIG. 13 is a diagram showing the relationship between the amount of dirt and the light transmittance of wash water.
Figure 14:
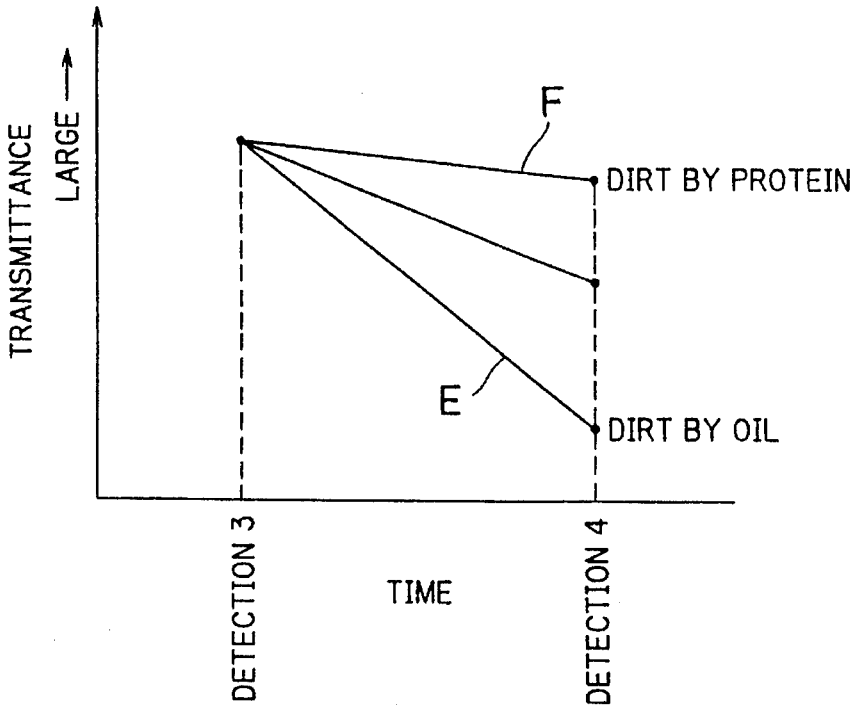
FIG. 14 is a diagram showing the relationship between the quality of dirt and the light transmittance of wash water.

FIG. 13 is a diagram showing the relationship between the amount of dirt and the transmittance, and FIG. 14 is a diagram showing the relationship between the quality of dirt and the transmittance. In FIGS. 13 and 14, the time point where the transmittance is detected before the water is supplied is taken as detection 1 (data stored in the buffer MA 42), the time point where the transmittance is detected before the washing operation is started after the water supply is taken as detection 2 (data stored in the buffer MB 43), the time point where the transmittance is detected after three minutes have elapsed since the washing operation was started is taken as detection 3 (data stored in the buffer MC 44), and the time point where the transmittance is detected at the time of the fuzzy process is taken as detection 4 (data stored in the buffer MD 45).

When an output of the transmittance detecting circuit 41 is not affected by garbage or the like, both the detected values (the transmittance) MA and MB in the detection 1 and the detection 2 are approximately a reference voltage (for example, 5 V). Thereafter, the washing operation is started.

Consider a case where the dishes become very dirty. In this case, if the washing operation is started to spray the wash water from the nozzle, much of dirt is dropped in the wash water, so that the wash water is frequently clouded. Accordingly, the transmittance in detection 3 is lowered. On the other hand, consider a case where the dishes become slightly dirty. In this case, the transmittance is slightly made lower than that before the start of the washing operation. However, the wash water does not become so dirty, so that the transmittance is relatively high. Consequently, the transmittance obtained in the detection 3 shown in FIG. 13, that is, the output voltage of the transmittance detecting circuit 41 represents the amount of dirt.

Furthermore, if dirt is caused by oil, the oil must be first softened by warm water, so that long time is required to drop the dirt from the dishes. Consequently, the light transmittance of the wash water is further lowered in the detection 4 performed at the time point where a certain time period has elapsed since the detection 3, as compared with that in the detection 3 performed when a predetermined short time period has elapsed since the washing operation was started (see a straight line E). On the other hand, when dirt is caused by proteins other than the oil, much of the dirt is dropped at the time point where the detection 3 is performed, so that there is little difference between the transmittance in the detection 3 and the transmittance in the detection 4, to display characteristics represented by a straight line F. Specifically, it is judged that dirt is mainly stubborn dirt such as dirt by oil if the difference between the transmittance in the detection 3 and the transmittance in the detection 4 is large, while being mainly dirt by proteins other than dirt by oil if it is small.

Figure 15:
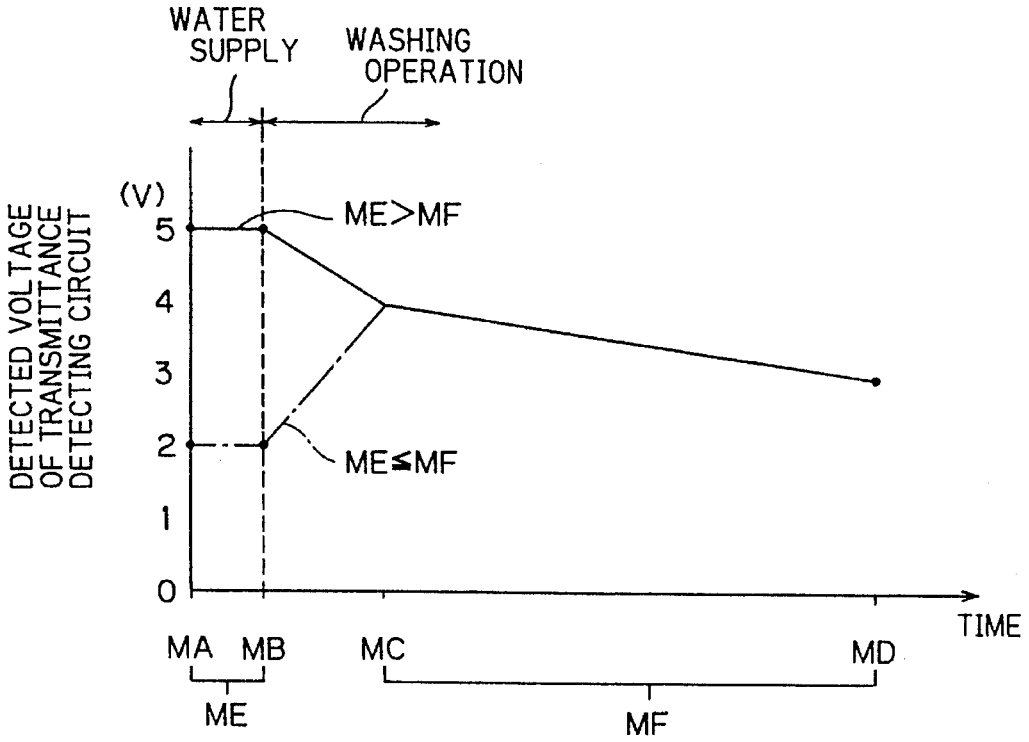
FIG. 15 is a graph showing the relationship between washing time and an output voltage of a transmittance detecting circuit 41.

Referring now to FIG. 15, description is made of a method of calculating the amount of dirt and the quality of dirt carried out in the steps S1-38, S1-39, S1-40 and S1-41.

In FIG. 15, the axis of abscissa represents time, and the axis of ordinate represents an output voltage of the transmittance detecting circuit 41. The transmittance detecting circuit 41 outputs a voltage of 5 V when the transmittance is 100%, and the outputted voltage is decreased as the transmittance is lowered Unless light received by the light receiving element 30 is intercepted due to the effect of garbage or the like as described above, the transmittance is 100% and the output of the transmittance detecting circuit 41 is 5 V before wash water is supplied and before the washing operation is started after the water supply. Thereafter, the detected value MC at the time when a predetermined short time period has elapsed since the washing operation was started is, for example, 4 V, and the detected value MD at a predetermined time point after further performing the washing operation is, for example, 3 V.

If the light emitting element 29 or the light receiving element 30 is degraded in performance due to the change with time, however, the output voltages MA and MB are not 5 V but, for example, 4.7 V to 4.8 V even if the transmittance is 100%. In addition, the voltages MC and MD thereafter detected are relatively low (although the entire graph indicated by a solid line in FIG. 15 is shifted relatively downward, it is not necessarily shifted by a predetermined amount as a whole). Accordingly, the value MC or MD cannot be directly used as a value indicating the amount of dirt. Therefore, the amount of dirt is found by correcting the value MF using the reference voltage "5 V" and the initial detected voltage ME by the foregoing equation (1).

Similarly, the quality of dirt is corrected using the reference voltage "5 V" and the initial detected voltage ME (see the equation (2)).

The amount of dirt and the quality of dirt are as follows if they are concretely represented by the voltages using the graph shown in FIG. 15:

$$\begin{aligned}\text{Amount of dirt} &= MD \times (\text{Reference voltage}/ME)\\ &= 3 \times (5/5) = 3(\text{V})\\ \text{Quality of dirt} &= (MD - MC) \times (\text{Reference voltage}/ME)\\ &= (3-4) \times (5/5) = -1(\text{V})\end{aligned}$$

On the other hand, a case where ME is not higher than MF in the step S1-37 shown in FIG. 10 is a case where the initial detected voltage takes a value which cannot be trusted due to garbage or the like. Specifically, it is a case indicated by a one-dot and dash line in FIG. 15. In such a case, the value ME is not used considering that it is erroneous, to find the amount of dirt and the quality of dirt using the values MC and MD which are actually detected. In this case, therefore, the degradation of the light receiving element 30 and the like due to the change with time is not corrected.

Figure 16:
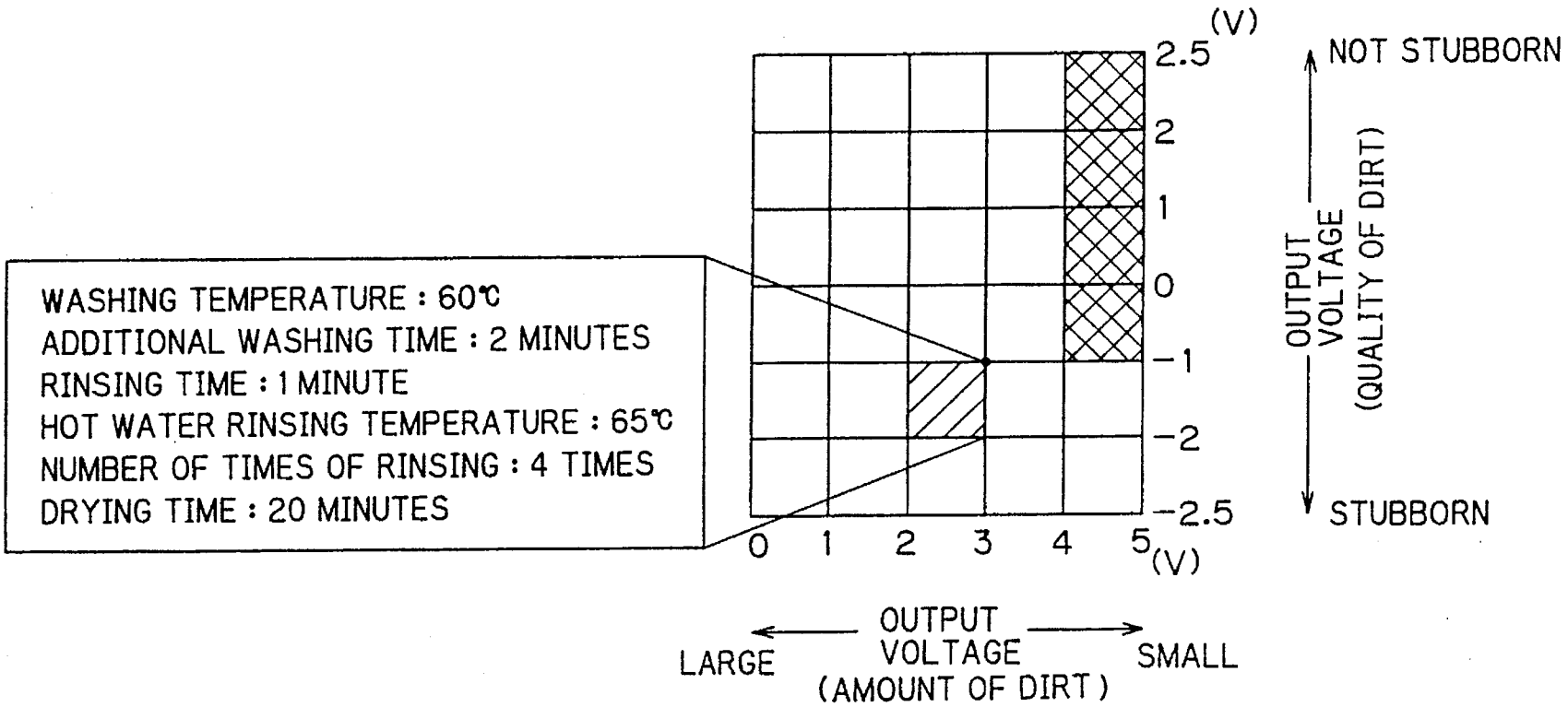
FIG. 16 is an illustration for explaining a fuzzy look-up table previously set.

In the step S1-42 shown in FIG. 10, the amount of dirt and the quality of dirt which are calculated in the foregoing steps S1-38 and S1-39, or the amount of dirt and the quality of dirt which are calculated in the steps S1-40 and S1-41 are applied to a fuzzy look-up table shown in FIG. 16, to determine the contents of control of the additional washing operation, the rinsing process, the hot water rinsing process and the drying process as well as select the type of drainage process, that is, either one of the sequences X and Y shown in FIG. 5.

In the fuzzy look-up table shown in FIG. 16, an output voltage representing the amount of dirt is used to enter the axis of abscissa and an output voltage representing the quality of dirt is used to enter the axis of ordinate, and a washing temperature, additional washing time, rinsing time, a hot water rinsing temperature, the number of times of rinsing, and drying time are previously set for each block. Therefore, the above described voltages representing the amount of dirt and the quality of dirt which are calculated are applied to the look-up table, thereby to make it possible to obtain the contents of control required. In this concrete example, the amount of dirt is 3 V, and the quality of dirt is −1 V. Accordingly, the contents of control described in a block indicated by hatching are read out as the contents of control thereafter required.

Furthermore, in the look-up table, if the output voltage representing the amount of dirt is not less than 4 V, and the output voltage representing the quality of dirt is not less than −1 V as indicated by crosshatching in FIG. 16, it is judged that the degree of dirt on the dishes is relatively low, whereby the sequence Y shown in FIG. 5 is selected. If the output voltages are in the other ranges, it is judged that the degree of dirt on the dishes is relatively high, whereby the sequence X shown in FIG. 5 is selected.

When it is judged that the degree of dirt on the dishes is relatively low, the sequence Y in which an operation of draining wash water at the same time that the wash water is supplied is not included in the latter part of the washing process or the rinsing process and a time period for the final drainage operation is made shorter than that in the sequence X is selected. The reason for this is that the rinsing effect can be sufficiently produced even if the above described operation of simultaneous water supply and drainage is not included in the latter part of the process because the degree of dirt on the dishes is relatively low, thereby to prevent water from being uselessly used.

Figure 17:
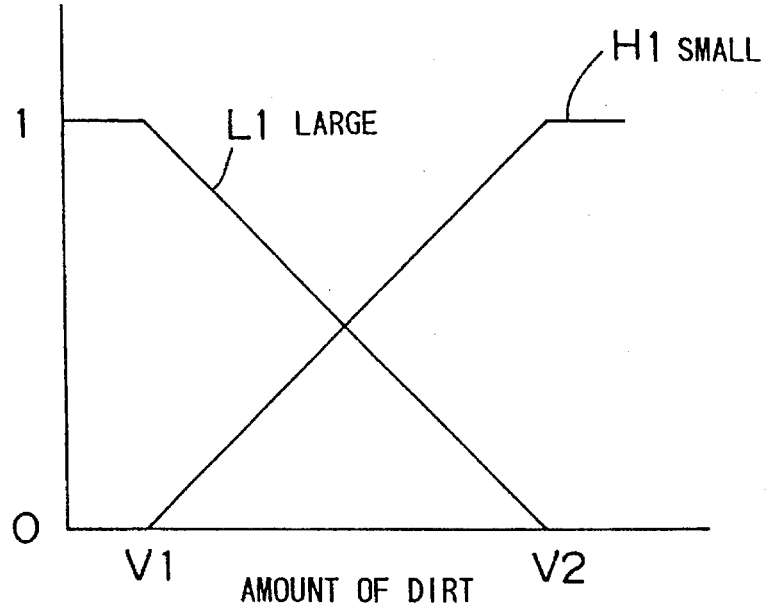
FIG. 17 is a diagram showing fuzzy membership functions related to the amount of dirt.
Figure 18:
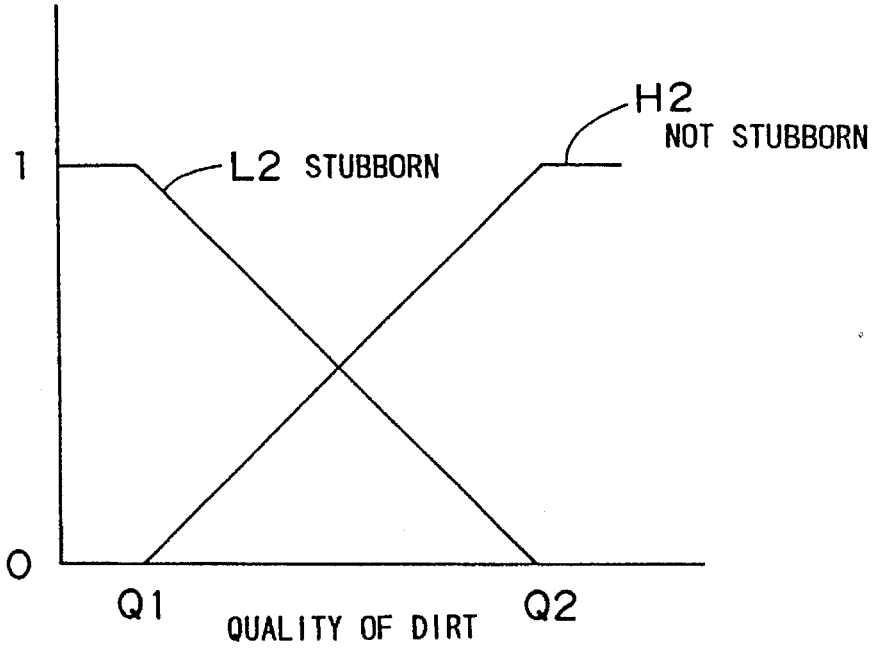
FIG. 18 is a diagram showing fuzzy membership functions related to the quality of dirt.

The contents of control set in the fuzzy look-up table shown in FIG. 16 are predetermined by executing fuzzy inference on the basis of membership functions shown in FIGS. 17 and 18 and a fuzzy rule shown in Table 1.

Description is now made of membership functions. In FIG. 17, a label L1 is a membership function with respect to "the amount of dirt is large", and a label H1 is a membership function with respect to "the amount of dirt is small". If the voltage representing the amount of dirt is less than V1, the degree belonging to the label L1 is 1 (100%). However, if the voltage representing the amount of dirt is from V1 to V2, the degree belonging to the label L1 is gradually decreased from 1 to 0 as the amount of dirt is decreased. If the voltage representing the amount of dirt is not less than V2, the degree belonging to the label L1 becomes 0. On the other hand, if the voltage representing the amount of dirt is less than V1, the degree belonging to the label H1 is 0, and the degree belonging to the label H1 is increased from 0 to 1 as the amount of dirt is decreased. If the voltage representing the amount of dirt is not less than V2, the degree belonging to the label H1 is 1.

Furthermore, in FIG. 18, a label L2 is a membership function with respect to "the quality of dirt is large (dirt is stubborn)", and a label H2 is a membership function with respect to "the quality of dirt is small (dirt is not stubborn)". If the voltage representing the quality of dirt is less than Q1, the degree belonging to the label L2 is 1 (100%). However, if the voltage representing the quality of dirt is from Q1 to Q2, the degree belonging to the label L2 is gradually decreased from 1 to 0 as the voltage representing the quality of dirt is changed from Q1 to Q2. If the voltage representing the quality of dirt is not less than Q2, the degree belonging to the label L2 is 0. On the other hand, if the voltage representing the quality of dirt is less than Q1, the degree belonging to the label H2 is 0, and the degree belonging to the label H2 is increased from 0 to 1 as the voltage representing the quality of dirt is changed from Q1 to Q2. If the voltage representing the quality of dirt is not less than Q2, the degree belonging to the label H2 is 1.

made short. In the rule (3), if both the amount of dirt and the quality of dirt are small, then the additional washing temperature is made low, the additional washing time is made very short, the rinsing time is made short, the hot water rinsing temperature is made low, and the drying time is made long. In the rule (4), if the amount of dirt is small and the quality of dirt is large, then the additional washing temperature, the additional washing time and the rinsing time are made medium, the hot water rinsing temperature is made high, and the drying time is made short.

The degrees belonging to the label L1 and the label H1 in FIG. 17 and the degrees belonging to the label L2 and the label H2 in FIG. 18 are applied to the fuzzy rule shown in Table 1 as input data, and a inference operation of the input data is performed using a center of gravity method, to calculate the contents of control such as the additional washing temperature and the additional washing time with respect to various amounts and qualities of dirt. The results are set in the fuzzy look-up table (see FIG. 16).

Figure 11:
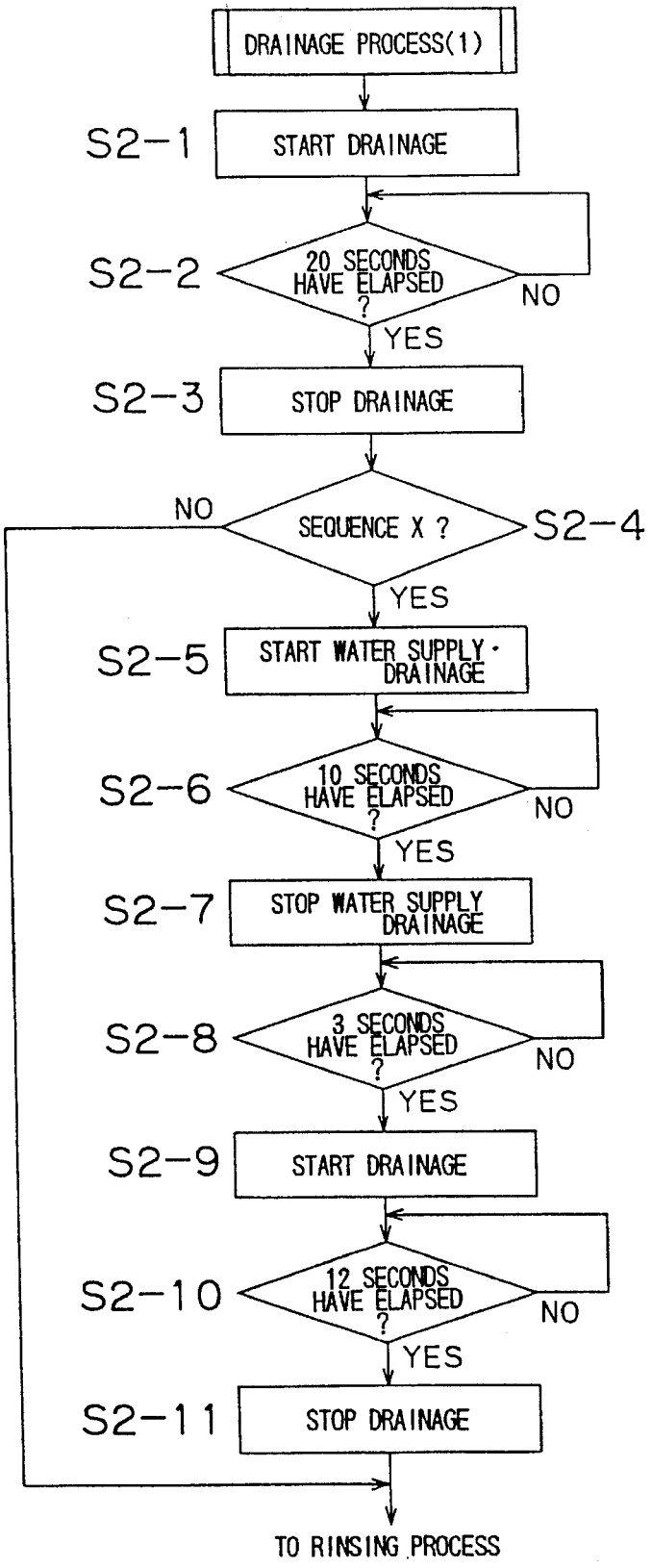
FIG. 11 is a flow chart showing operations in the first drainage process.

FIG. 11 is a flow chart showing operations in the first drainage process. The first drainage process corresponds to processing in the latter part of the washing process.

Referring to FIG. 11, in the first drainage process, the pump 7 is first rotated in the reverse direction to start drainage in the step S2-1. It is judged in the step S2-2 whether or not 20 seconds have elapsed since the drainage was started. If 20 seconds have elapsed since the drainage was started, the pump 7 is turned off in the step S2-3, to stop the drainage, after which the program proceeds to the step S2-4.

In the step S2-4, it is judged which of the sequences X and Y is selected depending on the degree of dirt on the dishes in the washing process. That is, the results in the step S1-42 shown in FIG. 10 are referred to. If the degree of dirt on the dishes is relatively high to select the sequence X, drainage processing based on the sequence X in the steps S2-5 to S2-11 is performed. Specifically, in the step S2-5, the water supply valve 22 is opened and the pump 7 is rotated in the reverse direction, to start simultaneous water supply and drainage. In the step S2-6, it is judged whether or not 10 seconds have elapsed since the water supply and drainage was started. If 10 seconds have elapsed, the water supply and

TABLE 1

| | IF | | THEN | | | | |
|---|---|---|---|---|---|---|---|
| rule | amount of dirt | quality of dirt | additional washing temperature | additional washing time | rinsing time | hot water rinsing temperature | drying time |
| ① | large | small | slightly high | slightly long | short | medium | slightly short |
| ② | large | large | very high | long | long | high | short |
| ③ | small | small | low | very short | short | low | long |
| ④ | small | large | medium | medium | medium | high | short |

Description is now made of the fuzzy rule shown in Table 1. In a rule (1), if the amount of dirt is large and the quality of dirt is small, then the additional washing temperature is made slightly high, the additional washing time is made slightly long, the rinsing time is made short, the hot water rinsing temperature is made medium, and the drying time is made slightly short. In the rule (2), if both the amount of dirt and the quality of dirt are large, then the additional washing temperature is made very high, the additional washing time is made long, the rinsing time is made long, the hot water rinsing temperature is made high, and the drying time is drainage is stopped in the step S2-7. In the step S2-8, the elapse of three seconds is waited for. In the step S2-9, the pump 7 is rotated in the reverse direction, so that only the drainage is started. In the step S2-10, it is judged whether or not 12 seconds have elapsed since the drainage was started. If 12 seconds have elapsed in the step S2-11, the drainage is stopped, after which the program proceeds to the rinsing process.

On the other hand, if the degree of dirt on the dishes is relatively low to select the sequence Y in the step S2-4, the program proceeds to the rinsing process without performing the processing in the foregoing steps S2-5 to S2-11 on the basis of the contents of the operations in the sequence Y.

In the first drainage process, if the degree of dirt on the dishes is thus relatively low, the program proceeds to the rinsing process without performing the drainage processing in the steps S2-5 to S2-11 on the basis of the sequence Y obtained by changing the contents of the operations in the sequence X corresponding to a case where the degree of dirt on the dishes is relatively high, thereby to make it possible to prevent water from being uselessly used in the latter part of the washing process as well as shorten the washing time.

Figure 12:
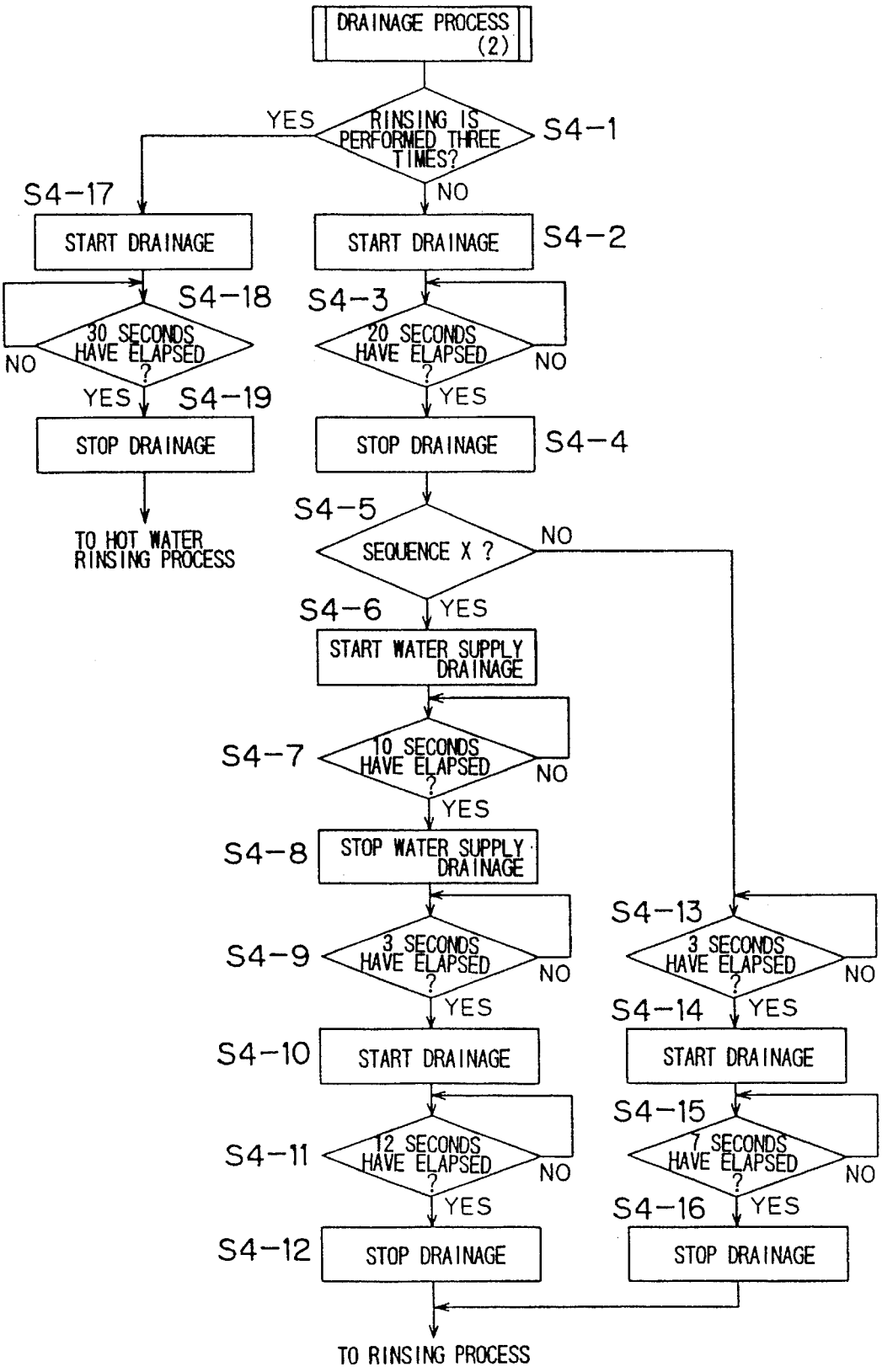
FIG. 12 is a flow chart showing operations in the second drainage process.

FIG. 12 is a flow chart showing processing in the second drainage process. The second drainage process represents the latter part of each of the rinsing 1 process, the rinsing 2 process and the rinsing 3 process shown in FIG. 5.

Referring to FIG. 12, in the second drainage process, it is judged in the step S4-1 whether or not rinsing is performed three times. If the rinsing is not performed three times, the program proceeds to the step S4-2. In the step S4-2, the pump 7 is rotated in the reverse direction to start drainage. It is judged in the step $4-3 whether or not 20 seconds have elapsed since the drainage was started. If 20 seconds have elapsed since the drainage was started, the pump 7 is turned off to stop the drainage in the step S4-4, after which the program proceeds to the step S4-5.

It is judged in the step S4-5 which of the sequences X and Y is selected depending on the degree of dirt on the dishes in the washing process. That is, the results in the step S1-42 shown in FIG. 10 are referred to. If the sequence X is selected, processing based on the sequence X in the step S4-6 to S4-12 is performed. Specifically, in the step S4-6, the water supply valve 22 is opened and the pump 7 is rotated in the reverse direction, to start simultaneous water supply and drainage. If it is judged in the step S4-7 that the water supply and drainage is performed for 10 seconds, the water supply and drainage is stopped in the step S4-8. It is judged in the step S4-9 whether or not three seconds have elapsed since the water supply and drainage was stopped. If three seconds have elapsed since the water supply and drainage was stopped, the pump 7 is rotated in the reverse direction, to start the drainage again in the step S4-10. It is judged in the step S4-11 whether or not 12 seconds have elapsed since the drainage was started. If 12 seconds have elapsed since the drainage was started, the drainage is stopped in the step S4-12, after which the program proceeds to the rinsing process.

On the other hand, if the sequence Y is selected in the step S4-5, processing based on the sequence Y is performed. Specifically, it is judged in the step S4-13 whether or not three seconds have elapsed since the water supply and drainage was stopped in the step S4-4. If three seconds have elapsed since the water supply and drainage was stopped, the pump 7 is rotated in the reverse direction, to start the drainage again in the step S4-14. After additional drainage is performed for seven seconds in the step S4-15 since the drainage was started, the drainage is stopped in the step S4-16, after which the program proceeds to the rinsing process.

As described in the foregoing, in each of the respective rinsing processes, drainage processing corresponding to the dirt on the dishes based on the sequence X or the sequence Y is performed in the latter part of the rinsing process. As a result, if the degree of dirt on the dishes is relatively low, it is possible to prevent water from being uselessly used in the latter part of the rinsing process as well as shorten the rinsing time.

If the rinsing is performed three times in the step S4-1, the program proceeds to the step S4-17. In the step S4-17, the pump 7 is rotated in the reverse direction, to start the drainage. It is judged in the step S4-18 whether or not 30 seconds have elapsed since the drainage was started. If 30 seconds have elapsed since the drainage was started, the drainage is stopped in the step S4-19, after which the program proceeds to the hot water rinsing process.

Although in the above described embodiment, description was made of an example in which the sequence X corresponding to a case where the degree of dirt on the dishes is high and the sequence Y corresponding to a case where the degree of dirt on the dishes is low are stored, and the sequence X or the sequence Y is selected depending on the degree of dirt on the dishes. If the sequence X corresponding to a case where the degree of dirt on the dishes is high may be used as a reference sequence to omit or shorten the contents of processing in the drainage process in the reference sequence if the degree of dirt on the dishes is low.

Furthermore, although in the above described embodiments, the degree of dirt on the dishes is automatically detected, the degree of dirt on the dishes may be manually inputted by a user.

Additionally, although in the above described embodiment, description was made of an example in which the contents in the sequences of both the washing and rinsing processes are changed depending on the degree of dirt on the dishes, the contents in the sequences of either one of the washing and rinsing processes may be changed depending on the degree of dirt on the dishes.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dish washing machine comprising:

a cavity for containing the dishes;

water supplying means for supplying wash water to said cavity;

a nozzle for spraying the wash water on the dishes;

water feeding means for feeding into said nozzle the wash water supplied to said cavity to spray the wash water from said nozzle;

water draining means for draining the wash water outward from said cavity;

storing means storing a first sequence corresponding to a case where the degree of dirt on the dishes is relatively high and a second sequence corresponding to a case where the degree of dirt on the dishes is relatively low;

means for outputting a signal representing the degree of dirt on the dishes; and control means for controlling the driving of said water supplying means and said water draining means on the basis of the first sequence stored in said storing means in response to the application of a signal indicating that the degree of dirt on the dishes is relatively high from said outputting means, while controlling the driving of said water supplying means and said water draining means on the basis of the second sequence stored in said storing means in response to the application of a signal indicating that the degree of dirt on the dishes is relatively low from said outputting means, wherein:

the first sequence stored in said storing means includes an operation of simultaneously starting the water supplying means and the water draining means to drain wash water at the same time that the wash water is supplied, and the second sequence stored in said storing means does not include the operation of simultaneously starting the water supplying means and the water draining means to drain wash water at the same time that the wash water is supplied.

2. The dish washing machine according to claim 1, wherein said control means further controls the water feeding means on the basis of the first sequence or the second sequence stored in said storing means, each of the first sequence and the second sequence including an operation in the washing process and an operation in the rinsing process.

3. The dish washing machine according to claim 1, wherein the first sequence stored in said storing means includes as the rinsing process basic operations of water supply, rinsing, stop and drainage, and including operations of simultaneous water supply and drainage, stop and drainage as operations subsequent to the basic operations, and the second sequence stored in said storing means does not include the operation of simultaneous water supply and drainage after said basic operations.

4. The dish washing machine according to claim 1, wherein in the second sequence stored in said storing means, time for the drainage operation performed at the end of the rinsing process is set to time shorter than time for a final drainage operation in the rinsing process in the first sequence.

5. The dish washing machine according to claim 1, wherein a plurality of rinsing processes are set in each of the first sequence and the second sequence which are stored in said storing means.

6. The dish washing machine according to claim 1, wherein said means for outputting a signal representing the degree of dirt on the dishes comprises transmittance detecting means for detecting the transmittance of the wash water supplied to said cavity, and means for judging and outputting the degree of dirt on the dishes on the basis of the transmittance detected by said transmittance detecting means.

7. A dish washing machine for spraying water on dishes contained in a cavity having a washing process for washing the dishes in the cavity and a rinsing process for rinsing the dishes in the cavity, each washing process and rinsing process having a drainage process for draining wash water in the cavity, comprising:

storing means storing a first sequence having a first drainage operation and a second sequence having a second drainage operation, the first drainage operation being different from the second drainage operation;

means for outputting a signal representing a degree of dirt on the dishes; and control means for controlling the drainage processes in the washing process and the rinsing process on the basis of the first sequence stored in the storing means in response to the application of a signal indicating that the degree of dirt on the dishes is relatively high from the outputting means, while controlling drainage processes in the washing process and the rinsing process on the basis of the second sequence stored in the storing means in response to the application of a signal indicating that the degree of dirt on the dishes is relatively low from the outputting means.

8. The dish washing machine according to claim 7, wherein:

the first sequence stored in the storing means includes an operation of supplying wash water into the cavity during a predetermined period in the drainage process, and the second sequence stored in the storing means does not include the operation of supplying wash water into the cavity in the drainage process.

9. The dish washing machine according to claim 7, wherein:

the first sequence stored in said storing means includes an operation for draining wash water and supplying wash water at the same time; and the second sequence stored in said storing means does not include the operation for draining wash water and supplying wash water at the same time.

10. A dish washing machine, comprising:

a cavity for containing the dishes;

water supplying means for supplying wash water to said cavity;

a nozzle for spraying the wash water on the dishes;

water feeding means for feeding into said nozzle the wash water supplied to said cavity to spray the wash water from said nozzle;

water draining means for draining the wash water outward from said cavity;

storing means storing a first sequence in which particular operations are included corresponding to a case where a degree of dirt on the dishes is relatively high and a second sequence in which the particular operations are omitted corresponding to a case where the degree of dirt on the dishes is relatively low;

means for outputting a signal representing the degree of dirt on the dishes; and control means for controlling the driving of said water supplying means and said water draining means on the basis of the first sequence, in which particular operations are included stored, in said storing means in response to the application of a signal indicating that the degree of dirt on the dishes is relatively high from said outputting means, while controlling the driving of said water supplying means and said water draining means on the basis of the second sequence, in which particular operations are omitted, stored in said storing means in response to the application of a signal indicating that the degree of dirt on the dishes is relatively low from said signal outputting means.

11. A method for cleaning dishes in a dish washing machine having a cavity to contain dishes and having a washing process for washing the dishes in the cavity and a rinsing process for rinsing the dishes in the cavity, each washing process and rinsing process having a drainage process for draining wash water in the cavity, and the dish washing machine further including means for storing both a first sequence having a first drainage operation and a second sequence having a second drainage operation with the first drainage operation being different from the second drainage operation, the method comprising:

activating a means for outputting a signal representing the degree of dirt on the dishes as well as a means for controlling, which means for controlling controls the drainage processes in the washing process and the rinsing process on the basis of the first sequence stored in the storing means in response to the application of a signal indicating that the degree of dirt on the dishes is relatively high from the outputting means, and controls drainage processes in the washing process and the rinsing process on the basis of the second sequence stored in the storing means in response to the application of a signal indicating that the degree of dirt on the dishes is relatively low from the outputting means.

12. A method of cleaning dishes as recited in claim 11, further comprising, before the step of outputting a signal representing the degree of dirt on the dishes, the step of:

detecting the degree of dirt on the dishes.

* * * * *